US008845281B2

(12) United States Patent
Cerretelli et al.

(10) Patent No.: US 8,845,281 B2
(45) Date of Patent: Sep. 30, 2014

(54) CENTRIFUGAL COMPRESSOR FOR WET GAS ENVIRONMENTS AND METHOD OF MANUFACTURE

(75) Inventors: Ciro Cerretelli, Maderno (IT); Kripa Kiran Varanasi, Lexington, MA (US); Michael Bernhard Schmitz, VS-Villingen (DE); Emad Ahmad Obaid Gharaibah, Nesoeya (NO); Christopher Edward Wolfe, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 779 days.

(21) Appl. No.: 12/997,494

(22) PCT Filed: Jun. 8, 2009

(86) PCT No.: PCT/US2009/046604

§ 371 (c)(1),
(2), (4) Date: Feb. 22, 2011

(87) PCT Pub. No.: WO2009/152088

PCT Pub. Date: Dec. 17, 2009

(65) Prior Publication Data

US 2011/0142607 A1 Jun. 16, 2011

(30) Foreign Application Priority Data

Jun. 12, 2008 (EP) ..... 08158132

(51) Int. Cl.

| | |
|---|---|
| ***F04D 29/70*** | (2006.01) |
| ***F04D 29/02*** | (2006.01) |
| ***F04D 29/28*** | (2006.01) |
| ***F04D 29/42*** | (2006.01) |

(52) U.S. Cl.

CPC ..... *F04D 29/023* (2013.01); *F04D 29/284* (2013.01); *F04D 29/4206* (2013.01); *F04D 29/701* (2013.01)

USPC ..... 415/169.2; 415/200; 415/217.1

(58) Field of Classification Search

USPC ..... 415/169.1, 169.2, 169.3, 217.1, 198.1, 415/199.1, 199.2

See application file for complete search history.

(56) References Cited

U.S. PATENT DOCUMENTS

| | | | |
|---|---|---|---|
| 2,786,626 | A | 3/1957 | Redcay |
| 4,695,224 | A | 9/1987 | Lown |

(Continued)

FOREIGN PATENT DOCUMENTS

| | | | |
|---|---|---|---|
| CN | 1417370 | A | 5/2003 |
| CN | 101048597 | A | 10/2007 |

(Continued)

OTHER PUBLICATIONS

EP Search Report and Opinion dated Jun. 25, 2009 from corresponding EP Application No. 08158132.4.

(Continued)

*Primary Examiner* — Richard Edgar

(74) *Attorney, Agent, or Firm* — Global Patent Operation; Peter T. DiMauro

(57) ABSTRACT

A centrifugal compressor comprises at least one stage suited to separate a liquid phase and a gas phase with the aid of at least one of a hydrophobic, super-hydrophobic, hydrophilic or super-hydrophilic surface layer, wherein the hydrophobic and/or super-hydrophobic surface layer is disposed on at least one of an inlet guide vane, impeller, return channel straight hub, or exiting hub bend; and the hydrophilic and/or super-hydrophilic surface is disposed on at least one of the impeller casing, diffuser casing, exiting casing bend, return channel straight hub, exiting hub bend, collection point, or drain.

17 Claims, 5 Drawing Sheets

(56) References Cited

U.S. PATENT DOCUMENTS

| | | | | |
|---|---|---|---|---|
| 5,580,214 | A | 12/1996 | Mohn | |
| 6,273,674 | B1 * | 8/2001 | Charron | 415/169.3 |
| 6,860,718 | B2 * | 3/2005 | Fukuda et al. | 415/173.5 |
| 7,083,389 | B2 | 8/2006 | Blangetti et al. | |
| 7,204,241 | B2 | 4/2007 | Thompson | |
| 8,132,414 | B2 | 3/2012 | Niizeki et al. | |
| 2002/0078696 | A1 | 6/2002 | Korin | |
| 2003/0069321 | A1 | 4/2003 | Lin et al. | |
| 2004/0211726 | A1 | 10/2004 | Baig et al. | |
| 2004/0213675 | A1 | 10/2004 | Blangetti et al. | |
| 2006/0045764 | A1 | 3/2006 | Thompson et al. | |
| 2006/0131235 | A1 | 6/2006 | Offeman et al. | |

FOREIGN PATENT DOCUMENTS

| | | | |
|---|---|---|---|
| EP | 1780379 | A | 5/2007 |
| EP | 1925782 | A | 5/2008 |
| GB | 2307276 | A | 5/1997 |
| JP | 2005518490 | A | 6/2005 |
| JP | 2007120478 | A | 5/2007 |
| WO | 8703051 | A1 | 5/1987 |
| WO | 2008062051 | A1 | 5/2008 |

OTHER PUBLICATIONS

PCT Search Report and Written Opinion dated Jul. 29, 2009 from corresponding Application No. PCT/US2009/046604.

Unofficial English translation of CN Office Action dated Jan. 29, 2013 from corresponding CN Application No. 200980131849.X.

JP Office Action dated Oct. 1, 2013 from corresponding JP Application No. 2011-513606.

* cited by examiner

CENTRIFUGAL COMPRESSOR FOR WET GAS ENVIRONMENTS AND METHOD OF MANUFACTURE

BACKGROUND OF THE INVENTION

1. Field of the Invention

The present disclosure is generally related to centrifugal compressors and methods of their manufacture.

2. Brief Description of the Prior Art

Natural gas fields that have been extensively used are characterized by increasingly higher water content, requiring increased use of wet gas treatment and technology. Existing devices are able to pump a two-phase mixture having a volumetric liquid content higher than 5%, but for lower liquid content, a typically bulky and costly separator is required. Axial compressors use fogging and inter-stage water injection in order to reduce compressor work: however, particles are usually atomized to sizes less than 10 mm (millimeter) and the volumetric liquid content is less than 0.1%, making evaporation very fast. Conventional centrifugal or axial compressors are also used to compress a mixture having a significant liquid content under non-conventional conditions such as, for example, water (or even ice) ingestion during takeoff or landing of turbofans and turbojets. However, continuous and prolonged operation under conditions where the liquid content is significant, albeit distributed in big droplets, is challenging due to erosion caused by the impact of the droplets on the impeller blades, corrosion, rotor unbalance and/or loss of efficiency due to the increased friction between the water and the impeller and compressor diffuser.

Traditionally, a first primary separation stage is generally used upstream of the compressor in order to perform a first separation of the gas and the liquid, followed by a second separation stage for separation of the finer droplets. The separation stage can be static and external to the compressor, or dynamic and embedded in the compressor outer case. This allows the compressor to operate on an almost fully gaseous medium and can be designed with standard techniques. The separated liquid is usually removed with a pump. However, these arrangements are typically bulky, complicated and expensive.

Ongoing challenges in the industry include reducing the absorbed power compared to a system having standard dry gas only compressors and separators, reducing the size, weight and cost of the upstream separators, eliminating the need for inter-stage separators, and devising systems using numerous wet-gas centrifugal compressor stages to replace systems having a rotating separator embedded in the compressor or a bulky static separator upstream of the compressor.

This disclosure pertains to the need to more efficiently separate wet gas mixtures in a centrifugal compressor, particularly for volumetric liquid content up to 5%.

BRIEF DESCRIPTION OF THE INVENTION

Accordingly, in one embodiment a centrifugal compressor comprises at least one stage suited to separate a liquid phase and a gas phase with the aid of at least one of a hydrophobic, super-hydrophobic, hydrophilic or super-hydrophilic surface layer, wherein the hydrophobic and/or super-hydrophobic surface layer is disposed on at least one of an inlet guide vane, impeller, return channel straight hub, or exiting hub bend; and the hydrophilic and/or super-hydrophilic surface is disposed on at least one of the impeller casing, diffuser casing, exiting casing bend, return channel straight hub, exiting hub bend, collection point, or drain.

In another embodiment, a method comprises disposing a hydrophobic and/or super-hydrophobic surface layer on at least one of an inlet guide vane, impeller, return channel straight hub, or exiting hub bend of at least one stage of a centrifugal compressor: and/or disposing a hydrophilic and/or super-hydrophilic surface layer on at least one of the impeller casing, diffuser casing, exiting casing bend, return channel straight hub, exiting hub bend, collection point, or drain of the at least one stage; wherein the centrifugal compressor is suited to separate a liquid phase and a gas phase from a wet gas mixture.

Other features and advantages of the disclosed centrifugal compressor will be or become apparent to one with skill in the art upon examination of the following drawings and detailed description.

BRIEF DESCRIPTION OF THE DRAWINGS

In the drawings, like reference numerals designate corresponding parts throughout the several views.

DETAILED DESCRIPTION OF THE INVENTION

Disclosed herein is a centrifugal compressor device for the treatment and transportation of a gas-water mixture and two-phase gas-liquid mixtures in general. The compressor employs hydrophobic, super-hydrophobic, hydrophilic and/or super-hydrophilic layers on selected surfaces exposed to wet gas, which improve the performance of the machine in wet conditions. The purpose is to achieve the same separation efficiency and operability that are typical of a more complex system constituted by a standard centrifugal compressor for dry gases preceded by scrubbers or separators, but to do so by using smaller, simpler and cheaper scrubbers and separators. This becomes possible by means of a wet compressor stage, which, by accepting a limited amount of water in the flow stream, is able to ease the load on the upstream separator. The compressor is useful, for example, in applications requiring a mixture with a heavy content of water to be transported and compressed without prior treatment, or a downstream installation that is characterized by an undersized or incomplete separation means, leaving heavy liquid content. More particularly, the device is intended for compression of a gaseous mixture with a liquid content from greater than about 0% up to about 5% in volume.

Figure 1:
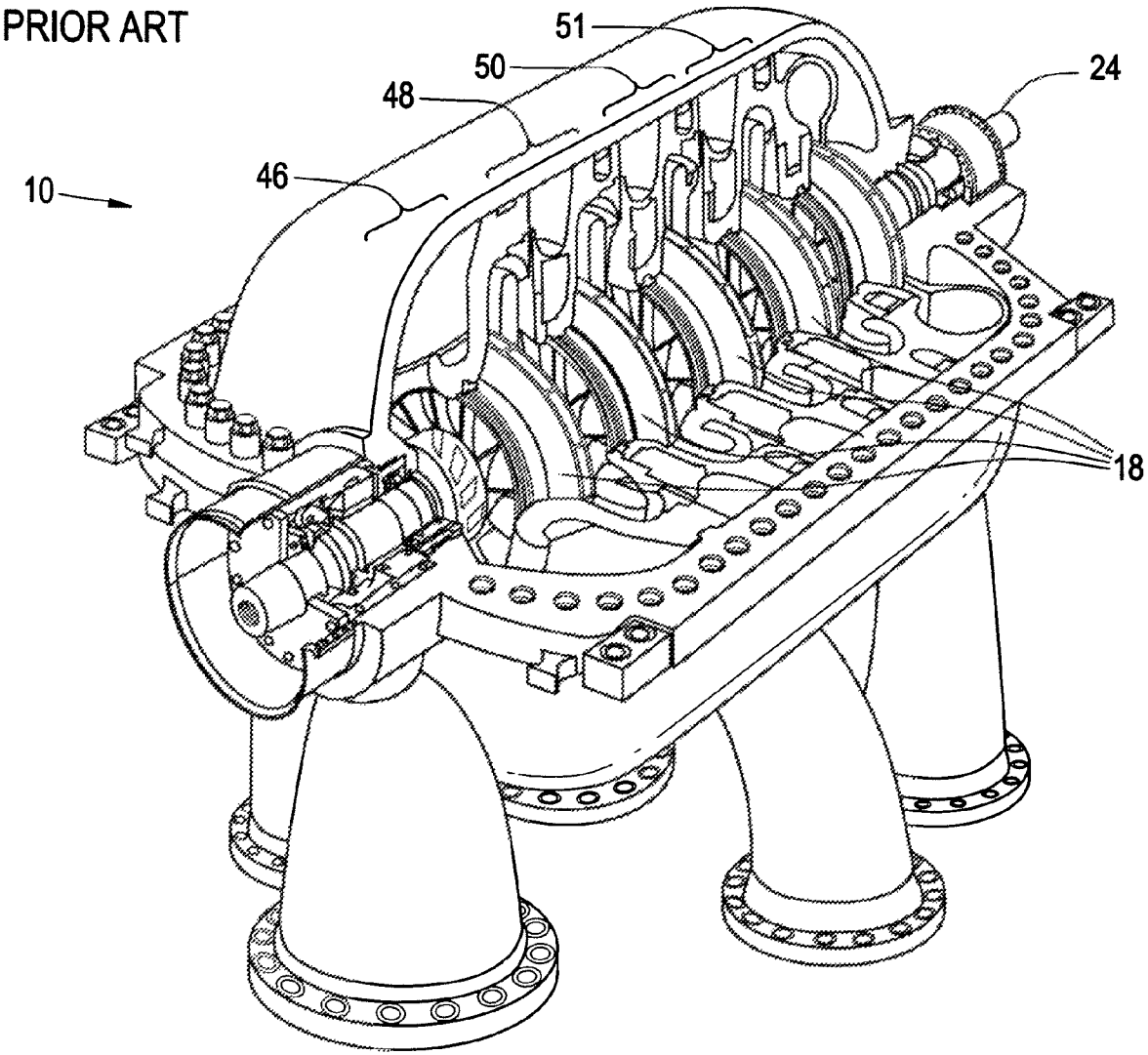
FIG. 1 PRIOR ART
FIG. 1 is a 3-dimensional cut-out image of a representative prior art centrifugal compressor having four stages.

FIG. 1 depicts a 3-dimensional cut-out of a representative prior art centrifugal compressor 10 having four stages 46, 48, 50 and 51, impellers 18, and rotatable shaft 24. A larger or smaller number of stages can be employed.

Figure 2:
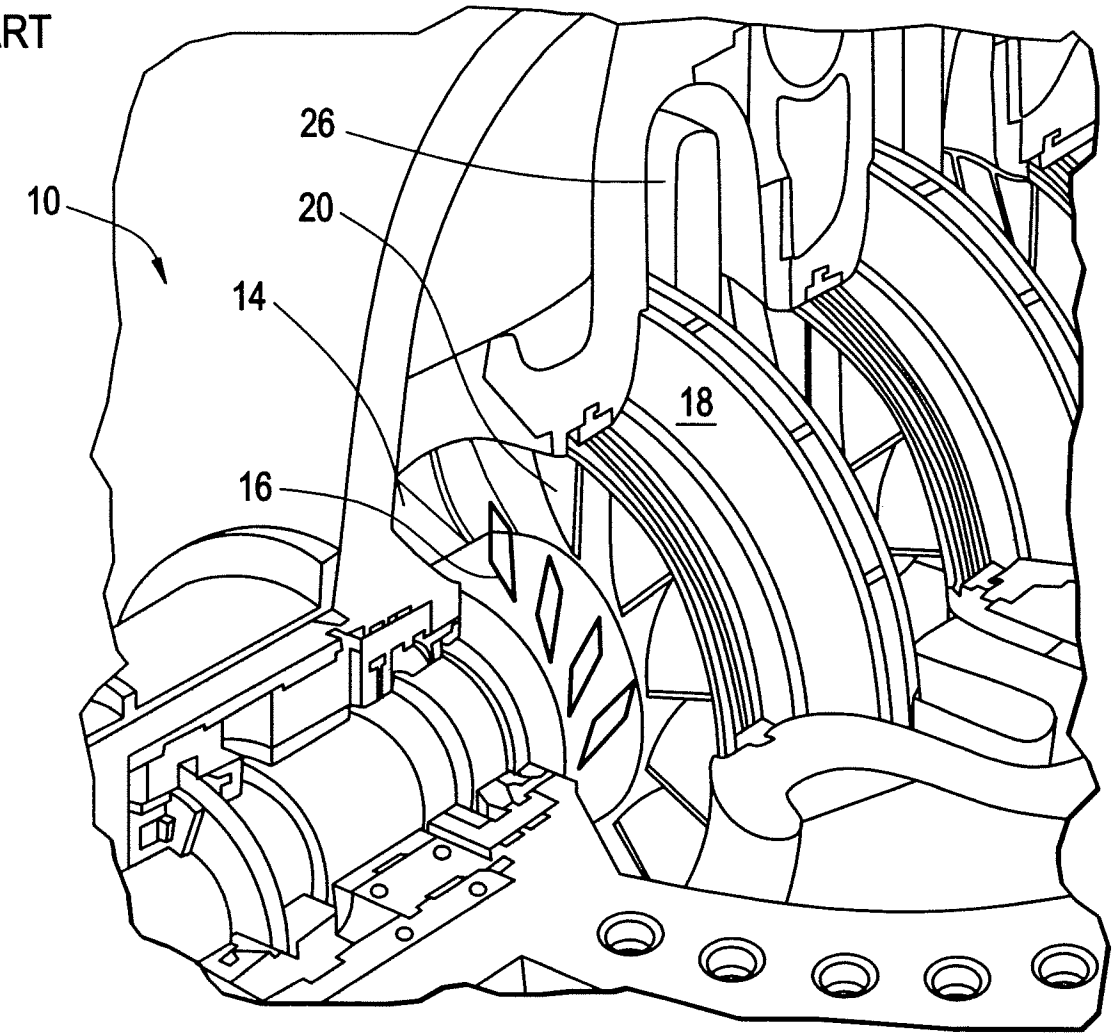
FIG. 2 PRIOR ART
FIG. 2 is a 3-dimensional close-up of the cut-out view of the first stage of the prior art centrifugal compressor.

FIG. 2 is a 3-dimensional close-up view of the first stage of prior art centrifugal compressor 10, showing passage 14, inlet guide vanes 16, impeller 18, impeller vanes 20, and diffuser 26.

Figure 3:
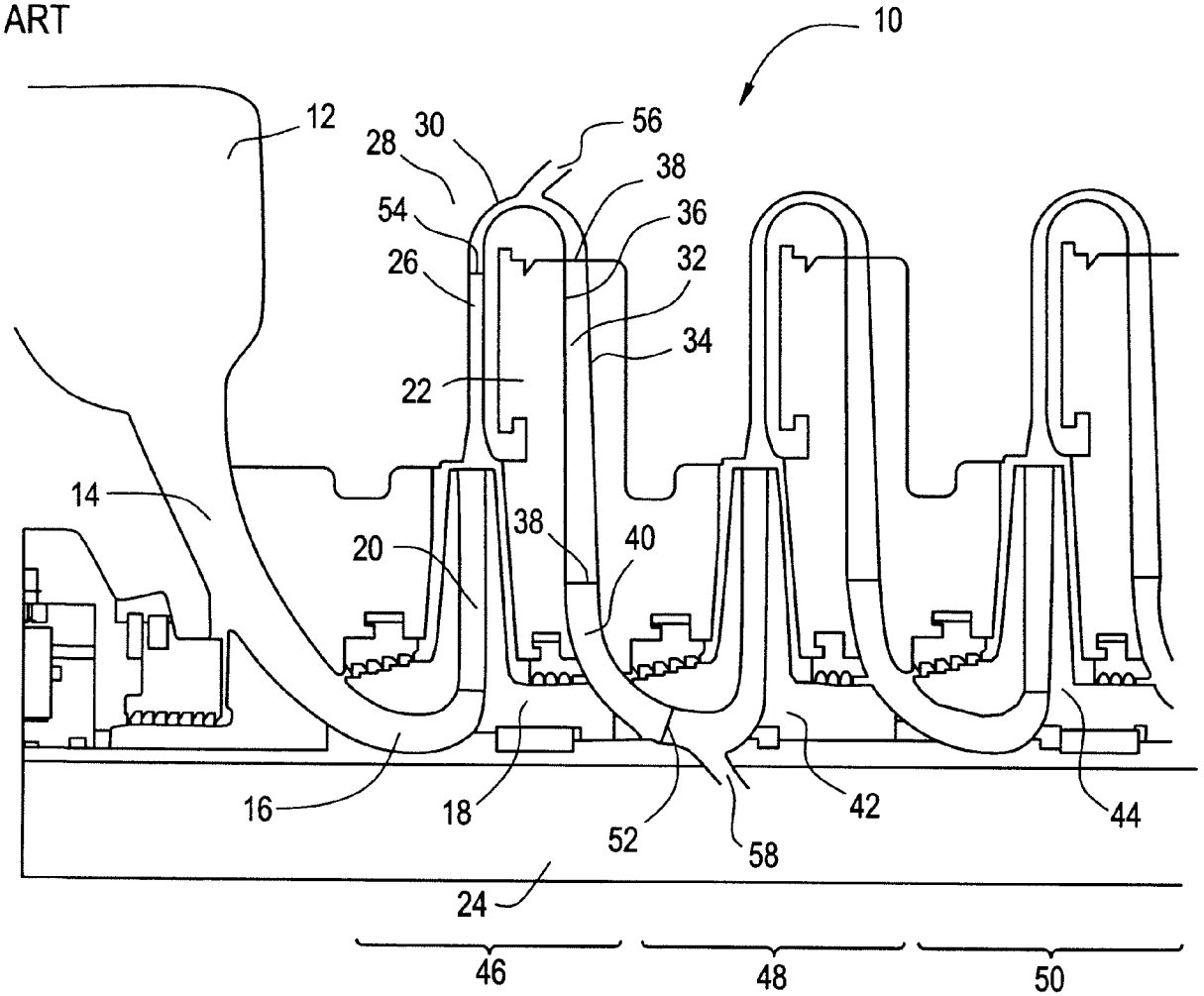
FIG. 3 PRIOR ART
FIG. 3 is a schematic cross-section of a Prior Art centrifugal compressor showing three stages.

FIG. 3 is a schematic cross-section of prior art centrifugal compressor 10 showing three stages, 46, 48 and 50. The mainly gaseous mixture comprising water droplets of varying sizes enters stage one 46 of compressor 10 through inlet channel 12 and travels through passage 14 having inlet guide vanes 16 into a first multi-bladed impeller 18 comprising impeller vanes 20 and impeller casing 22. Impeller 18 is attached to a rotatable shaft 24. The high rotational velocity of impeller 18 directs the gas centrifugally into a diffuser 26 having diffuser casing 28 and diffuser exiting casing bend 30. The gas stream being compressed passes through the diffuser exiting casing bend 30 followed by a return channel 32 having return channel casing 34, return channel straight hub 36, and deswirl vanes 38 for directing the gaseous mixture into exiting hub bend 40 and into a further multi-bladed impeller 42, representing a second stage 48 of the compressor 10. Multi-bladed impeller 44 represents a third stage 50 of compressor 10, respectively. Also shown are collection points 52 and 54 that serve to transition the water film from the inner wall to the outer walls for eventual removal via drains 56 and 58.

Figure 4:
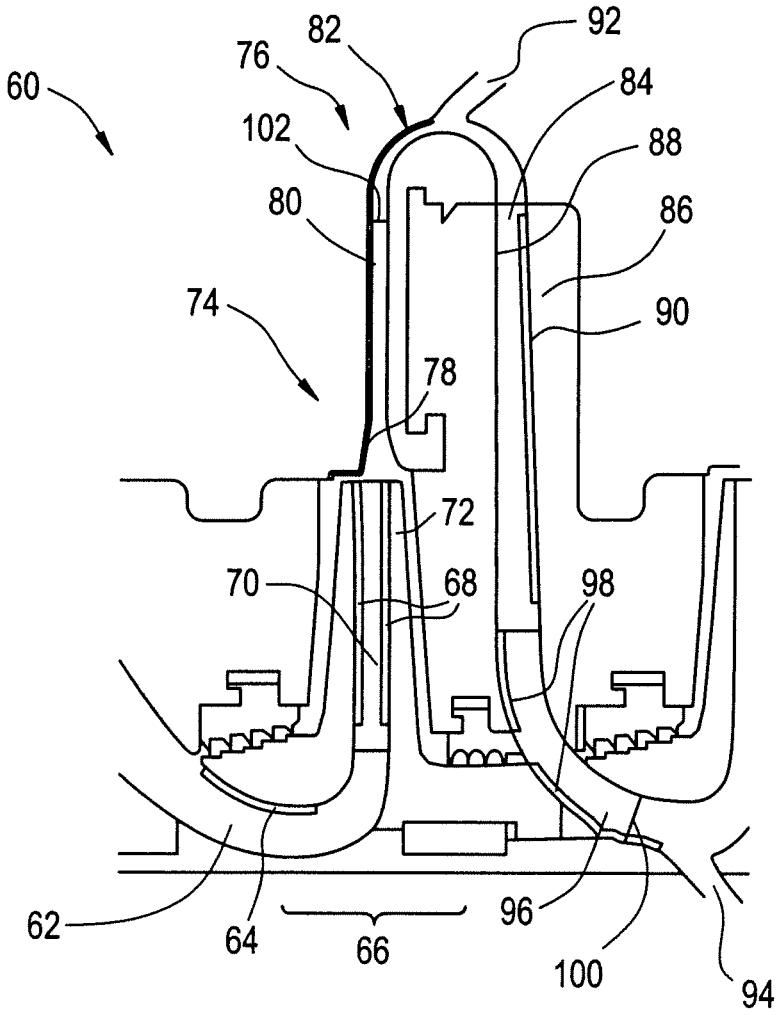
FIG. 4 is a schematic cross-section of a single stage of the disclosed centrifugal compressor having hydrophilic and hydrophobic layers disposed on selected surfaces that are exposed to a wet gas mixture. The thicker lines represent the surfaces comprising the hydrophilic and hydrophobic layers.

FIG. 4 is a schematic of a first stage of a centrifugal compressor 60 employing a plurality of stages wherein the at least one stage comprises selected surfaces comprising a hydrophobic, super-hydrophobic, hydrophilic and/or super-hydrophilic surface layers disposed thereon. In operation, hydrophobic, super-hydrophobic, hydrophilic, and/or super-hydrophilic surface layers are in direct contact with the wet gas stream. In this embodiment, inlet guide vanes 62 are coated with a hydrophobic or super-hydrophobic layer 64 to minimize moisture droplet size. This aids in reducing erosion caused by the impact of liquid phase droplets with the impeller blades, which is the main cause of major damage to impeller blades. Likewise, a surface of impeller 66, including impeller blade 70 and/or impeller hub 72, is coated with a hydrophobic and/or super-hydrophobic layer 68 to avoid the creation of thick liquid film layers on the impeller blade 70 and impeller hub 72 that would hinder efficient operation since they increase friction and alter the design velocity triangle distribution. The impeller casing 74 and the diffuser casing 76 are coated with hydrophilic or super-hydrophilic material 78 and 80 respectively in order to facilitate the formation of a liquid film on the wall. Such liquid film proceeds then to the exiting casing bend 82 before a return channel 84 for which a radius of curvature is properly selected to collect the separated water in a draining system. The return channel casing 86 and/or return channel straight hub 88 is coated with a hydrophobic and/or super-hydrophobic surface layer 90 to further minimize droplet formation. First collection point 102 and second collection point 100 are coated with hydrophilic or super-hydrophilic surface layers to facilitate the transition of the liquid film from the inner wall to the outer wall. First drain 92 and second drain 94 remove the liquid film from the exiting casing bend 82 and/or the exiting hub bend 96, respectively. A hydrophilic or super-hydrophilic layer 98 on the exiting hub bend 96, together with a properly designed radius on the exiting hub bend 96 upstream of the following impeller, helps collect the remaining liquid phase that will thus be extracted through second drain 94, before the next stage. At this point, the two-phase mixture has a substantially smaller liquid content. Should moisture separation still be needed, additional stages can follow having an identical configuration to the first stage downstream of the inlet guide vanes 62. Otherwise, the remaining centrifugal stages could be suited for dry gas only and be designed accordingly.

The combination of hydrophobic, super-hydrophobic, hydrophilic and/or super-hydrophilic surface layers provide the means to efficiently separate the gas phase from the liquid phase and discourage formation of liquid droplets, impeding erosion of the impeller blades and in particular, the leading edge of the impeller blades. The separated liquid phase can either be collected and discarded through a purposely designed piping system, or alternatively be reinserted through atomization in successive stages of the compressor for intercooling purposes in effective enough fashion to reduce compression work.

Thus, in one embodiment, a centrifugal compressor comprises at least one stage suited to separate a liquid phase and a gas phase with the aid of at least one of a hydrophobic, super-hydrophobic, hydrophilic or super-hydrophilic surface layer, wherein the hydrophobic and/or super-hydrophobic surface layer is disposed on at least one of an inlet guide vane, impeller, return channel straight hub, or exiting hub bend; and the hydrophilic and/or super-hydrophilic surface is disposed on at least one of the impeller casing, diffuser casing, exiting casing bend, return channel straight hub, exiting hub bend, collection point, or drain. In one embodiment, the centrifugal compressor comprises 1 to 10 stages. In one embodiment, the wet gas mixture comprises a moisture content from greater than about 0% up to about 5% by volume.

In this disclosure, the "liquid wettability", or "wettability," of a solid surface is determined by observing the nature of the interaction occurring between the surface and a drop of water disposed on the surface. A surface having a high wettability tends to allow the water drop to spread over a relatively wide area of the surface (thereby "wetting" the surface), and the static contact angle of the drop with the surface ranges from about 5 degrees to about 90 degrees. These are termed hydrophilic surfaces. In the extreme case, the liquid spreads into a film over the surface, and has a static contact angle of about 0 degrees to less than about 5 degrees. These are termed super-hydrophilic surfaces. On the other hand, where the surface has low wettability, water tends to retain a well-formed, ball-shaped drop having a static contact angle of greater than about 90 degrees to about 175 degrees. These surfaces are termed hydrophobic surfaces. In the extreme case, the water forms nearly spherical drops having a static contact angle of greater than about 175 degrees to about 180 degrees, and the drops easily roll off of the surface at the slightest disturbance. These surfaces are termed super-hydrophobic.

In one embodiment the hydrophilic layer comprises a filler selected from the group consisting of metal, plastic, ceramic, glass, and a combination of the foregoing tillers. These include chalk, glass spheres, glass microspheres, mineral fiber such as wollastonite, glass fiber, carbon fiber, and ceramic fiber such as silicon nitride or carbide fiber. In one embodiment, the hydrophilic layer comprises a finely divided, generally spherical metal, ceramic or metal/ceramic material mechanically or metallurgically bonded to the first surface by a brazing alloy. A metal/ceramic hydrophilic layer comprises, based on total weight of the metal/ceramic hydrophilic layer, about 60 wt % to about 80 wt % (weight percent) metal/ceramic material and about 20 wt % to about 40 wt % brazing alloy, and more particularly about 70 wt % to about 80 wt % metal/ceramic material and about 20 wt % to about 30 wt % brazing alloy. A metal hydrophilic layer comprises based on total weight of the metal hydrophilic layer about 80 wt % to about 99 wt % metal material and about 1 wt % to about 20 wt % brazing alloy, and more particularly about 90 wt % to about 99 wt % metal material and about 1 wt % to about 2 wt % brazing alloy. A ceramic hydrophilic layer comprises based on total weight of the ceramic hydrophilic layer about 40 wt % to about 70 wt % ceramic material and about 30 wt % to about 60 wt % brazing alloy, and more particularly about 50 wt % to about 60 wt % ceramic material and about 40 wt % to about 50 wt % brazing alloy.

Where hydrophilicity must be increased, the ratio of the metal, metal/ceramic, or ceramic material to brazing alloy can be increased at the expense of decreased adhesion of the hydrophilic layer to the metal substrate surface. Conversely, when better adhesion is required, the ratio can be decreased which will result in decreased hydrophilicity.

Also contemplated are bond coat layers disposed between the metal substrate surface and the hydrophilic layer to provide optimal adhesion of the hydrophilic layer to the metal substrate of the compressor.

Exemplary metals for hydrophilic layers include aluminum, cobalt, silicon, manganese, chromium, titanium, zirconium, iron, selenium, nickel or a combination comprising at least one of the foregoing metals. Metals can further be combined with a non-metal element selected from the group consisting of carbon, boron, phosphorous, sulfur, oxygen, nitrogen, and a combination comprising at least one of the foregoing elements.

Brazing causes the hydrophilic layer components to bond together and seal the various interfaces of the components. The brazing operation also can also serve to degrade a temporary organic binder of the coating without any appreciable residue. The brazing alloy can comprise any metallic brazing alloy that metallurgically or mechanically bonds the metal, metal ceramic or ceramic powder of the hydrophilic layer to a selected substrate. Exemplary brazing compounds include nickel and cobalt brazing compounds sold under the trade name COLMONOY® and NICROBRAZ® by Wall Colmonoy. However, any material that will metallurgically or mechanically bond the hydrophilic composition to the substrate is contemplated providing it does not adversely affect adhesion or the desirable hydrophilic properties of the layer.

Exemplary ceramic materials for the hydrophilic layer comprises a metal oxide material selected from the group consisting of unhydrated alumina, hydrated alumina, erbia, yttria, calcic, ceria, scandia, magnesia, india, ytterbia, lanthana, gadolinia, neodymia, samaria, dysprosia, zirconia, europia, neodymia, praseodymia, urania, hafnia, yttria-stabilized zirconias, ceria-stabilized zirconias, calcia-stabilized zirconias, scandia-stabilized zirconias, magnesia-stabilized zirconias, india-stabilized zirconias, ytterbia-stabilized zirconias and combinations comprising at least one of the foregoing materials. See, for example, Kirk-Othmer's Encyclopedia of Chemical Technology, 3rd Ed., Vol. 24, pp. 882-883 (1984) for a description of various zirconias. Yttria-stabilized zirconias can comprise from about 1 wt % to about 20 wt % yttria (based on the combined weight of yttria and zirconia), and more typically from about 3 wt % to about 10 wt % yttria. These chemically stabilized zirconias can further include one or more of a second metal (e.g. a lanthanide or actinide) oxide. See U.S. Pat. No. 6,025,078 (Rickerby et al), issued Feb. 15, 2000 and U.S. Pat. No. 6,333,118 (Alperine et al), issued Dec. 21, 2001. Still other ceramic materials also include pyrochlores of general formula $A_2B_2O_7$ where A is a metal having a valence of 3+ or 2+ (e.g., gadolinium, aluminum, cerium, lanthanum or yttrium) and B is a metal having a valence of 4+ or 5+ (e.g. hafnium, titanium, cerium or zirconium) where the sum of the A and B valences is 7. Representative materials of this type include gadolinium-zirconate, lanthanum titanate, lanthanum zirconate, yttrium zirconate, lanthanum hafnate, cerium zirconate, aluminum cerate, cerium hafnate, aluminum hafnate and lanthanum cerate. Other examples are disclosed in U.S. Pat. No. 6,117,560 (Maloney), issued Sep. 12, 2000: U.S. Pat. No. 6,177,200 (Maloney), issued Jan. 23, 2001: U.S. Pat. No. 6,284,323 (Maloney), issued Sep. 4, 2001: U.S. Pat. No. 6,319,614 (Beele), issued Nov. 20, 2001; and U.S. Pat. No. 6,387,526 (Beele), issued May 14, 2002.

Other exemplary ceramic materials include those disclosed in U.S. nonprovisional applications entitled "CERAMIC COMPOSITIONS USEFUL FOR THERMAL BARRIER COATINGS HAVING REDUCED THERMAL CONDUCTIVITY" (Spitsberg et al). Ser. No. 10/748,508, filed Dec. 30, 2003 and entitled "CERAMIC COMPOSITIONS USEFUL IN THERMAL BARRIER COATINGS HAVING REDUCED THERMAL CONDUCTIVITY" (Spitsberg et al), Ser. No. 10/748,520, filed Dec. 30, 2003, corresponding to U.S. Pat. No. 6,960,395 issued Nov. 1, 2005 and U.S. Pat. No. 7,364,802 issued Apr. 29, 2008. The ceramic compositions disclosed in the first of these references comprise at least about 91 mole % zirconia and up to about 9 mole % of a stabilizer component comprising a first metal oxide having selected from the group consisting of yttria, calcia, ceria, scandia, magnesia, india, ytterbia and mixtures thereof; a second metal oxide of a trivalent metal atom selected from the group consisting of lanthana, gadolinia, neodymia, samaria, dysprosia, and mixtures thereof; and a third metal oxide of a trivalent metal atom selected from the group consisting of erbia, ytterbia and mixtures thereof. Typically, these ceramic compositions comprise from about 91 mole % to about 97 mole % zirconia, more typically from about 92 mole % to about 95 mole % zirconia and from about 3 mole % to about 9 mole %, more typically from about 5 mole % to about 8 mole %, of the composition of the stabilizing component. The first metal oxide (typically yttria) can comprise from about 3 mole % to about 6 mole %, more typically from about 3 mole % to about 5 mole %, of the ceramic composition. The second metal oxide (typically lanthana or gadolinia) can comprise from about 0.25 mole % to about 2 mole %, more typically from about 0.5 mole % to about 1.5 mole %, of the ceramic composition. The third metal oxide (typically ytterbia) can comprise from about 0.5 mole % to about 2 mole %, more typically from about 0.5 mole % to about 1.5 mole %, of the ceramic composition, with the ratio of the second metal oxide to the third metal oxide typically being in the range of from about 0.5 mole % to about 2 mole %, more typically from about 0.75 mole % to about 1.33 mole %.

Still other ceramic compositions can comprise at least about 91 mole % zirconia and up to about 9 mole % of a stabilizer component comprising a first metal oxide selected from the group consisting of yttria, calcia, ceria, scandia, magnesia, india and mixtures thereof and a second metal oxide of a trivalent metal atom selected from the group consisting of lanthana, gadolinia, neodymia, samaria, dysprosia, erbia, ytterbia, and mixtures thereof. Typically, these ceramic compositions comprise from about 91 mole % to about 97 mole % zirconia, more typically from about 92 mole % to about 95 mole % zirconia and from about 3 mole to about 9 mole %, more typically from about from about 5 mole % to about 8 mole %, of the composition of the stabilizing component. The first metal oxide (typically yttria) can comprise from about 3 mole % to about 6 mole %, more typically from about 4 mole % to about 5 mole %, of the ceramic composition. The second metal oxide (typically lanthana, gadolinia or ytterbia, and more typically lanthana) can comprise from about 0.5 mole % to about 4 mole %, more typically from about 0.8 mole % to about 2 mole %, of the ceramic composition, and wherein the mole % ratio of second metal oxide (e.g., lanthana/gadolinia/ytterbia) to first metal oxide (e.g., yttria) is in the range of from about 0.1 to about 0.5, typically from about 0.15 to about 0.35, more typically from about 0.2 to about 0.3.

Figure 5:
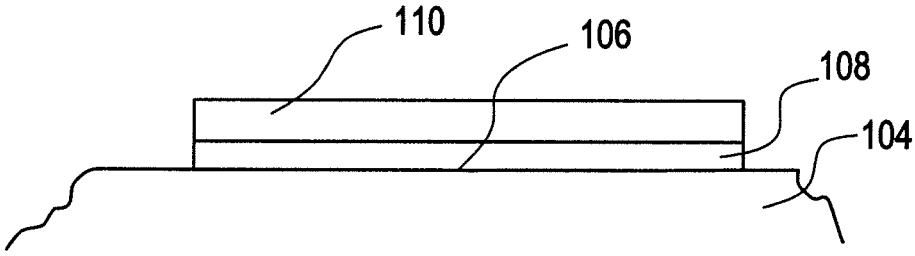
FIG. 5 is a schematic of a selected surface of a centrifugal layer having a bond coat layer disposed between a hydrophilic or hydrophobic layer and the substrate metal.

In one embodiment, a selected surface of a centrifugal compressor further comprises a bond coat layer disposed between the hydrophilic or hydrophobic layer. The bond coat layer enables the hydrophilic or hydrophobic layer to more tenaciously adhere to a selected surface of the compressor metal substrate. The selected surface includes any of the centrifugal compressor surfaces described above. FIG. 5 illustrates schematically a bond coat layer 108 disposed on a selected surface 106 of substrate 104, adjacent to and in contact with a top hydrophilic/superhydrophilic or hydrophobic/super-hydrophilic layer 110.

The bond coat layer can be formed from a metallic oxidation-resistant material that protects the underlying selected surface substrate. Exemplary materials for the bond coat layer include overlay bond coatings such MCrAlY alloys (e.g., alloy powders), where M represents a metal such as iron, nickel, platinum or cobalt, or NiAl(Zr) overlay coatings, as well as various noble metal diffusion aluminides such as platinum aluminide, as well as simple aluminides (i.e., those formed without noble metals) such as nickel aluminide.

The bond coat layer can be applied, deposited or otherwise formed on a selected surface by any of a variety of conventional techniques, such as electroless plating, physical vapor deposition (PVD), including electron beam physical vapor deposition (EB-PVD), plasma spray, including air plasma spray (APS) and vacuum plasma spray (VPS), ion plasma, or other thermal spray deposition methods such as high velocity oxy-fuel (HVOF) spray, detonation, or wire spray, chemical vapor deposition (CVD), pack cementation and vapor phase aluminiding in the case of metal diffusion aluminides (see, for example, U.S. Pat. No. 4,148,275 (Benden et al), issued Apr. 10, 1979: U.S. Pat. No. 5,928,725 (Howard et al), issued Jul. 27, 1999: and U.S. Pat. No. 6,039,810 (Mantkowski et al), issued Mar. 21, 2000 and combinations thereof). Typically, if a plasma spray or diffusion technique is employed to deposit a bond coat layer, the thickness is in the range of from about 25 micrometers to about 500 micrometers. For bond coat layers deposited by PVD techniques such as EB-PVD or diffusion aluminide processes, the thickness is more typically in the range of from about 25 micrometers to about 75 micrometers.

In applying a hydrophilic layer, it is frequently desirable for the coating composition to further comprise a vaporizable organic binder, or fugitive binder, to hold the metal, metal/ceramic, ceramic and brazing alloy components in place until metallurgical and/or mechanical bonding to the substrate surface and/or bond coat layer occurs. The precise amount of volatile organic binder is not particularly critical in that the organic binder is burnt off or vaporized in the assembly process.

The vaporizable organic binder can have any composition providing it does not adversely affect adhesion of the hydrophilic layer either to the selected surface or if present the bond coat layer, the organic binder does not adversely affect the moisture film forming properties of the hydrophilic layer, and the organic binder totally thermally degrades leaving little residue at the brazing temperature, for example, 500° C. to 700° C. Exemplary organic binders include cellulosics, acrylics, polyalcohols, polyacrylamides, polyethers, propylene glycol monomethyl ether acetate and other acetates, and mixtures thereof.

The advantages of the hydrophilic layer in enabling formation of a moisture film are recognized, at the very least, in terms of reduced erosion on the impellers and improved efficiency in separating a liquid phase from a gas phase in a wet gas mixture, thus lowering the power and improving the efficiency of the separation process compared to a centrifugal compressor lacking the hydrophilic layer.

In another embodiment, a selected surface of a centrifugal compressor comprises a hydrophilic layer comprising a crosslinked network of a non-fugitive organic binder and at least one of the above described fillers, wherein the organic binder does not undergo thermal degradation. In this embodiment the hydrophilic layer is not subjected to a temperature greater than approximately 300° C. The organic binder can comprise any hydrophilic thermoplastic or thermosetting material providing the adhesion and wet film-forming properties of the hydrophilic layer are not adversely affected.

The disclosed compressor also comprises one or more surfaces comprising a hydrophobic or super-hydrophobic layer disposed thereon. In one embodiment the hydrophobic or super-hydrophobic layer comprises a filler selected from the group consisting of metal, plastic, ceramic, glass, and a combination of the foregoing fillers.

Exemplary metal fillers for the hydrophobic layer include those selected from the group consisting of beryllium, magnesium, scandium, titanium, vanadium, chromium, manganese, iron, cobalt, nickel, copper, zinc, gallium, yttrium, zirconium, niobium, molybdenum, technetium, ruthenium, rhenium, palladium, silver, cadmium, indium, tin, lanthanum, cerium, praseodymium, neodymium, samarium, europium, gadolinium, terbium, dysprosium, holmium, erbium, thulium, ytterbium, lutetium, hafnium, tantalum, tungsten, rhenium, osmium, iridium, platinum, gold, thallium, lead, bismuth, and combinations comprising at least one of the foregoing metals. In particular the metal filler is titanium, aluminum, magnesium, nickel or a combination thereof. Even more particularly, the metal filler is an aluminum-magnesium alloy, particularly preferably $AlMg_3$.

In one embodiment, the hydrophobic layer further comprises a thermosetting or thermoplastic resin. Exemplary thermosetting resins include diallyl phthalate resins, epoxy resins, urea-formaldehyde resins, melamine-formaldehyde resins, melamine-phenol-formaldehyde resins, phenol-formaldehyde resins, polyimides, silicone rubbers and unsaturated polyester resins, or a combination comprising at least one of the foregoing thermosetting resins.

Exemplary thermoplastic resins include thermoplastic polyolefin, e.g. polypropylene or polyethylene, polycarbonate, polyester carbonate, polyester (e.g. poly(butylene terephthalate) (PBT) or poly(ethylene terephthalate) (PET), polystyrene, styrene copolymer, styrene-acrylonitrile (SAN) resin, rubber-containing styrene graft copolymer, e.g. acrylonitrile-butadiene-styrene (ABS) polymer, polyamide, polyurethane, polyphenylene sulphide, polyvinyl chloride or a combination comprising at least one of the foregoing thermoplastic resins.

Exemplary polyolefins include polyethylene of high and low density, i.e. densities of about 0.91 g/cm$^3$ to about 0.97 g/cm$^3$, or polypropylenes with molecular weights of from about 10,000 g/mol to about 1,000,000 g/mol.

Other copolymers of olefins or with further α-olefins are contemplated, such as, for example, polymers of ethylene with butene, hexene and/or octene, EVA (ethylene-vinyl acetate copolymers), EBA (ethylene-ethyl acrylate copolymers), EEA (ethylene-butyl acrylate copolymers), EAS (acrylic acid-ethylene copolymers), EVK (ethylene-vinylcarbazole copolymers), EPB (ethylene-propylene block copolymers), EPDM (ethylene-propylene-diene copolymers), PB (polybutylenes), PMP (poly-methylpentenes), PIB (polyisobutylenes), NBR (acrylonitrile-butadiene copolymers), polyisoprenes, methyl-butylene copolymers, isoprene-isobutylene copolymers.

As used herein, the term "polycarbonate" means compositions having repeating structural carbonate units of formula (1):

(1)

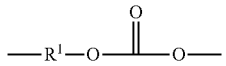

in which at least about 60 percent of the total number of $R^1$ groups contain aromatic moieties and the balance thereof are aliphatic, alicyclic, or aromatic. In an embodiment, each $R^1$ is a $C_{6-30}$ aromatic group, that is, contains at least one aromatic moiety. $R^1$ can be derived from a dihydroxy compound of the formula HO—$R^1$—OH, in particular of formula (2):

$$HO\text{-}A^1\text{-}Y^1\text{-}A^2\text{-}OH \quad (2)$$

wherein each of $A^1$ and $A^2$ is a monocyclic divalent aromatic group and $Y^1$ is a single bond or a bridging group having one or more atoms that separate $A^1$ from $A^2$. In an exemplary embodiment, one atom separates $A^1$ from $A^2$. Specifically, each $R^1$ can be derived from a dihydroxy aromatic compound of formula (3)

(3)

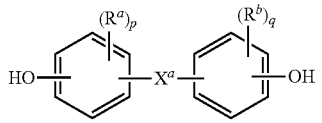

wherein $R^a$ and $R^b$ each represent a halogen or $C_{1-12}$ alkyl group and can be the same or different; and p and q are each independently integers of 0 to 4. It will be understood that $R^a$ is hydrogen when p is 0, and likewise $R^b$ is hydrogen when q is 0. Also in formula (3), $X^a$ represents a bridging group connecting the two hydroxy-substituted aromatic groups, where the bridging group and the hydroxy substituent of each $C_6$ arylene group are disposed ortho, meta, or para (specifically para) to each other on the $C_6$ arylene group. In an embodiment, the bridging group $X^a$ is single bond, —O—, —S—, —S(O)—, —$S(O)_2$—, —C(O)—, or a $C_{1-18}$ organic group. The $C_{1-18}$ organic bridging group can be cyclic or acyclic, aromatic or non-aromatic, and can further comprise heteroatoms such as halogens, oxygen, nitrogen, sulfur, silicon, or phosphorous. The $C_{1-18}$ organic group can be disposed such that the $C_6$ arylene groups connected thereto are each connected to a common alkylidene carbon or to different carbons of the $C_{1-18}$ organic bridging group. In one embodiment, p and q are each 1, and $R^a$ and $R^b$ are each a $C_{1-3}$ alkyl group, specifically methyl, disposed meta to the hydroxy group on each arylene group.

In an embodiment, $X^a$ is a substituted or unsubstituted $C_{3-18}$ cycloalkylidene, a $C_{1-25}$ alkylidene of formula —C($R^c$)($R^d$)— wherein $R^c$ and $R^d$ are each independently hydrogen, $C_{1-12}$ alkyl, $C_{1-12}$ cycloalkyl, $C_{7-12}$ arylalkyl, $C_{1-12}$ heteroalkyl, or cyclic $C_{7-12}$ heteroarylalkyl, or a group of the formula —C(=$R^c$)— wherein $R^c$ is a divalent $C_{1-12}$ hydrocarbon group. Exemplary groups of this type include methylene, cyclohexylmethylene, ethylidene, neopentylidene, and isopropylidene, as well as 2-[2.2.1]-bicycloheptylidene, cyclohexylidene, cyclopentylidene, cyclododecylidene, and adamantylidene. A specific example wherein $X^a$ is a substituted cycloalkylidene is the cyclohexylidene-bridged, alkyl-substituted bisphenol of formula (4)

(4)

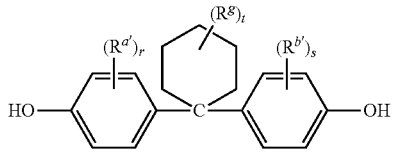

wherein $R^{a'}$ and $R^{b'}$ are each independently $C_{1-12}$ alkyl, $R^g$ is $C_{1-12}$ alkyl or halogen, r and s are each independently 1 to 4, and t is 0 to 10. In a specific embodiment, at least one of each of $R^{a'}$ and $R^{b'}$ are disposed meta to the cyclohexylidene bridging group. The substituents $R^{a'}$, $R^{b'}$, and $R^g$ can, when comprising an appropriate number of carbon atoms, be straight chain, cyclic, bicyclic, branched, saturated, or unsaturated. In an embodiment, $R^{a'}$ and $R^{b'}$ are each independently $C_{1-4}$ alkyl, $R^g$ is $C_{1-4}$ alkyl, r and s are each 1, and t is 0 to 5. In another specific embodiment, $R^{a'}$, $R^{b'}$ and $R^g$ are each methyl, r and s are each 1, and t is 0 or 3. The cyclohexylidene-bridged bisphenol can be the reaction product of two moles of o-cresol with one mole of cyclohexanone. In another exemplary embodiment, the cyclohexylidene-bridged bisphenol is the reaction product of two moles of a cresol with one mole of a hydrogenated isophorone (e.g., 1,1,3-trimethyl-3-cyclohexane-5-one). Such cyclohexane-containing bisphenols, for example the reaction product of two moles of a phenol with one mole of a hydrogenated isophorone, are useful for making polycarbonate polymers with high glass transition temperatures and high heat distortion temperatures. Cyclohexyl bisphenol-containing polycarbonates, or a combination comprising at least one of the foregoing with other bisphenol polycarbonates, are supplied by Bayer Co. under the APEC® trade name.

In another embodiment, $X^a$ is a $C_{1-18}$ alkylene group, a $C_{3-18}$ cycloalkylene group, a fused $C_{6-18}$ cycloalkylene group, or a group of the formula —$B^1$—W—$B^2$— wherein $B^1$ and $B^2$ are the same or different $C_{1-6}$ alkylene group and W is a $C_{3-12}$ cycloalkylidene group or a $C_{6-16}$ arylene group.

$X^a$ can also be a substituted $C_{3-18}$ cycloalkylidene of formula (5):

(5)

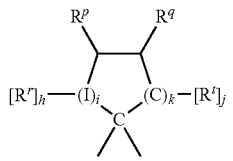

wherein $R^r$, $R^p$, $R^q$, and $R^t$ are independently hydrogen, halogen, oxygen, or $C_{1-12}$ organic groups: I is a direct bond, a carbon, or a divalent oxygen, sulfur, or —N(Z)— where Z is hydrogen, halogen, hydroxy, $C_{1-12}$ alkyl, $C_{1-12}$ alkoxy, or $C_{1-12}$ acyl: h is 0 to 2, j is 1 or 2, i is an integer of 0 or 1, and k is an integer of 0 to 3, with the proviso that at least two of $R^r$, $R^p$, $R^q$, and $R^t$ taken together are a fused cycloaliphatic, aromatic, or heteroaromatic ring. It will be understood that where the fused ring is aromatic, the ring as shown in formula (5) will have an unsaturated carbon-carbon linkage where the ring is fused. When k is one and i is 0, the ring as shown in formula (5) contains 4 carbon atoms: when k is 2, the ring as shown in formula (5) contains 5 carbon atoms: and when k is 3, the ring contains 6 carbon atoms. In one embodiment, two adjacent groups (e.g., $R^q$ and $R^t$ taken together) form an aromatic group, and in another embodiment, $R^q$ and $R^t$ taken together form one aromatic group and $R^r$ and $R^p$ taken together form a second aromatic group. When $R^q$ and $R^t$ taken together form an aromatic group. $R^p$ can be a double-bonded oxygen atom, i.e., a ketone.

Other useful aromatic dihydroxy compounds of the formula HO—$R^1$—OH include compounds of formula (6)

(6)

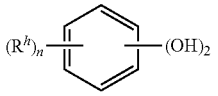

wherein each $R^h$ is independently a halogen atom, a $C_{1-10}$ hydrocarbyl such as a $C_{1-10}$ alkyl group, a halogen-substituted $C_{1-10}$ alkyl group, a $C_{6-10}$ aryl group, or a halogen-substituted $C_{6-10}$ aryl group, and n is 0 to 4. The halogen is typically bromine.

Some illustrative examples of specific aromatic dihydroxy compounds include the following: 4,4'-dihydroxybiphenyl, 1,6-dihydroxynaphthalene, 2,6-dihydroxynaphthalene, bis(4-hydroxyphenyl)methane, bis(4-hydroxyphenyl)diphenylmethane, bis(4-hydroxyphenyl)-1-naphthylmethane, 1,2-bis(4-hydroxyphenyl)ethane, 1,1-bis(4-hydroxyphenyl)-1-phenylethane, 2-(4-hydroxyphenyl)-2-(3-hydroxyphenyl)propane, bis(4-hydroxyphenyl)phenylmethane, 2,2-bis(4-hydroxy-3-bromophenyl)propane, 1,1-bis(hydroxyphenyl)cyclopentane, 1,1-bis(4-hydroxyphenyl)cyclohexane, 1,1-bis(4-hydroxyphenyl)isobutene, 1,1-bis(4-hydroxyphenyl)cyclododecane, trans-2,3-bis(4-hydroxyphenyl)-2-butene, 2,2-bis(4-hydroxyphenyl)adamantane, alpha, alpha'-bis(4-hydroxyphenyl)toluene, bis(4-hydroxyphenyl)acetonitrile, 2,2-bis(3-methyl-4-hydroxyphenyl)propane, 2,2-bis(3-ethyl-4-hydroxyphenyl)propane, 2,2-bis(3-n-propyl-4-hydroxyphenyl)propane, 2,2-bis(3-isopropyl-4-hydroxyphenyl)propane, 2,2-bis(3-sec-butyl-4-hydroxyphenyl) propane, 2,2-bis(3-t-butyl-4-hydroxyphenyl)propane, 2,2-bis(3-cyclohexyl-4-hydroxyphenyl)propane, 2,2-bis(3-allyl-4-hydroxyphenyl)propane, 2,2-bis(3-methoxy-4-hydroxyphenyl)propane, 2,2-bis(4-hydroxyphenyl)hexafluoropropane, 1,1-dichloro-2,2-bis(4-hydroxyphenyl)ethylene, 1,1-dibromo-2,2-bis(4-hydroxyphenyl)ethylene, 1,1-dichloro-2,2-bis(5-phenoxy-4-hydroxyphenyl)ethylene, 4,4'-dihydroxybenzophenone, 3,3-bis(4-hydroxyphenyl)-2-butanone, 1,6-bis(4-hydroxyphenyl)-1,6-hexanedione, ethylene glycol bis(4-hydroxyphenyl)ether, bis(4-hydroxyphenyl)ether, bis(4-hydroxyphenyl)sulfide, bis(4-hydroxyphenyl)sulfoxide, bis(4-hydroxyphenyl)sulfone, 9,9-bis(4-hydroxyphenyl)fluorine, 2,7-dihydroxypyrene, 6,6'-dihydroxy-3,3,3',3'-tetramethylspiro(bis)indane ("spirobiindane bisphenol"), 3,3-bis(4-hydroxyphenyl)phthalimide, 2,6-dihydroxydibenzo-p-dioxin, 2,6-dihydroxythianthrene, 2,7-dihydroxyphenoxathin, 2,7-dihydroxy-9,10-di methyl phenazine, 3,6-dihydroxydibenzofuran, 3,6-dihydroxydibenzothiophene, and 2,7-dihydroxycarbazole, resorcinol, substituted resorcinol compounds such as 5-methyl resorcinol, 5-ethyl resorcinol, 5-propyl resorcinol, 5-butyl resorcinol, 5-t-butyl resorcinol, 5-phenyl resorcinol, 5-cumyl resorcinol, 2,4,5,6-tetrafluoro resorcinol, 2,4,5,6-tetrabromo resorcinol, or the like: catechol; hydroquinone; substituted hydroquinones such as 2-methyl hydroquinone, 2-ethyl hydroquinone, 2-propyl hydroquinone, 2-butyl hydroquinone, 2-t-butyl hydroquinone, 2-phenyl hydroquinone, 2-cumyl hydroquinone, 2,3,5,6-tetramethyl hydroquinone, 2,3,5,6-tetra-t-butyl hydroquinone, 2,3,5,6-tetrafluoro hydroquinone, 2,3,5,6-tetrabromo hydroquinone, or the like, or combinations comprising at least one of the foregoing dihydroxy compounds.

Specific examples of bisphenol compounds of formula (3) include 1,1-bis(4-hydroxyphenyl)methane, 1,1-bis(4-hydroxyphenyl)ethane, 2,2-bis(4-hydroxyphenyl) propane (also referred to as "bisphenol A" or "BPA"), 2,2-bis(4-hydroxyphenyl) butane, 2,2-bis(4-hydroxyphenyl)octane, 1,1-bis(4-hydroxyphenyl)propane, 1,1-bis(4-hydroxyphenyl)n-butane, 2,2-bis(4-hydroxy-1-methylphenyl)propane, 1,1-bis(4-hydroxy-t-butylphenyl)propane, 3,3-bis(4-hydroxyphenyl)phthalimidine, 2-phenyl-3,3-bis(4-hydroxyphenyl)phthalimidine (PPPBP), and 1,1-bis(4-hydroxy-3-methylphenyl)cyclohexane (DMBPC). Combinations comprising at least one of the foregoing dihydroxy compounds can also be used. In one specific embodiment, the polycarbonate is a linear homopolymer derived from bisphenol A, in which each of $A^1$ and $A^2$ is p-phenylene and $Y^1$ is isopropylidene in formula (3).

The polycarbonates can have an intrinsic viscosity, as determined in chloroform at 25° C. of about 0.3 to about 1.5 deciliters per gram (dl/gm), specifically about 0.45 to about 1.0 dl/gm. The polycarbonates can have a weight average molecular weight of about 10,000 to about 200,000 Daltons, specifically about 20,000 to about 100,000 Daltons, as measured by gel permeation chromatography (GPC), using a crosslinked styrene-divinylbenzene column and calibrated to polycarbonate references. GPC samples are prepared at a concentration of about 1 mg/ml, and are eluted at a flow rate of about 1.5 ml/min.

"Polycarbonates" as used herein further include homopolycarbonates, (wherein each $R^1$ in the polymer is the same), copolymers comprising different $R^1$ moieties in the carbonate (referred to herein as "copolycarbonates"), copolymers comprising carbonate units and other types of polymer units, such as ester units, and combinations comprising at least one of homopolycarbonates and/or copolycarbonates. As used herein, a "combination" is inclusive of blends, mixtures, alloys, reaction products, and the like.

A specific type of copolymer is a polyester carbonate, also known as a polyester-polycarbonate. Such copolymers further contain, in addition to recurring carbonate chain units of formula (1), repeating units of formula (7):

(7)

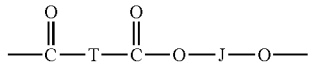

wherein J is a divalent group derived from a dihydroxy compound, and can be, for example, a $C_{2-10}$ alkylene group, a $C_{6-20}$ alicyclic group, a $C_{6-20}$ aromatic group or a polyoxyalkylene group in which the alkylene groups contain 2 to about 6 carbon atoms, specifically 2, 3, or 4 carbon atoms; and T divalent group derived from a dicarboxylic acid, and can be, for example, a $C_{2-10}$ alkylene group, a $C_{6-20}$ alicyclic group, a $C_{6-20}$ alkyl aromatic group, or a $C_{6-20}$ aromatic group. Copolyesters containing a combination of different T and/or J groups can be used. The polyesters can be branched or linear.

In one embodiment, J is a $C_{2-30}$ alkylene group having a straight chain, branched chain, or cyclic (including polycyclic) structure. In another embodiment, J is derived from an aromatic dihydroxy compound of formula (3) above. In another embodiment, J is derived from an aromatic dihydroxy compound of formula (4) above. In another embodiment, J is derived from an aromatic dihydroxy compound of formula (6) above.

Exemplary aromatic dicarboxylic acids that can be used to prepare the polyester units include isophthalic or terephthalic acid, 1,2-di(p-carboxyphenyl)ethane, 4,4'-dicarboxydiphenyl ether, 4,4'-bisbenzoic acid, or the like, or a combination comprising at least one of the foregoing acids. Acids containing fused rings can also be present, such as in 1,4-, 1,5-, or 2,6-naphthalenedicarboxylic acids. Exemplary dicarboxylic acids include terephthalic acid, isophthalic acid, naphthalene dicarboxylic acid, cyclohexane dicarboxylic acid, or the like, or a combination comprising at least one of the foregoing acids. A specific dicarboxylic acid comprises a combination of isophthalic acid and terephthalic acid wherein the weight ratio of isophthalic acid to terephthalic acid is about 91:9 to about 2:98. In another specific embodiment, J is a $C_{2-6}$ alkylene group and T is p-phenylene, m-phenylene, naphthalene, a divalent cycloaliphatic group, or a combination thereof. This class of polyester includes the poly(alkylene terephthalates).

The molar ratio of ester units to carbonate units in the copolymers can vary broadly, for example 1:99 to 99:1, specifically 10:90 to 90:10, more specifically 25:75 to 75:25, depending on the desired properties of the final composition.

In a specific embodiment, the polyester unit of a polyester-polycarbonate is derived from the reaction of a combination of isophthalic and terephthalic diacids (or derivatives thereof) with resorcinol. In another specific embodiment, the polyester unit of a polyester-polycarbonate is derived from the reaction of a combination of isophthalic acid and terephthalic acid with bisphenol A. In a specific embodiment, the polycarbonate units are derived from bisphenol A. In another specific embodiment, the polycarbonate units are derived from resorcinol and bisphenol A in a molar ratio of resorcinol carbonate units to bisphenol A carbonate units of 1:99 to 99:1.

Polycarbonates can be manufactured by processes such as interfacial polymerization and melt polymerization. Although the reaction conditions for interfacial polymerization can vary, an exemplary process generally involves dissolving or dispersing a dihydric phenol reactant in aqueous caustic soda or potash, adding the resulting mixture to a water-immiscible solvent medium, and contacting the reactants with a carbonate precursor in the presence of a catalyst such as triethylamine and/or a phase transfer catalyst, under controlled pH conditions, e.g., about 8 to about 12. The most commonly used water immiscible solvents include methylene chloride, 1,2-dichloroethane, chlorobenzene, toluene, and the like.

Exemplary carbonate precursors include a carbonyl halide such as carbonyl bromide or carbonyl chloride, or a haloformate such as a bishaloformates of a dihydric phenol (e.g., the bischloroformates of bisphenol A, hydroquinone, or the like) or a glycol (e.g., the bishaloformate of ethylene glycol, neopentyl glycol, polyethylene glycol, or the like). Combinations comprising at least one of the foregoing types of carbonate precursors can also be used. In an exemplary embodiment, an interfacial polymerization reaction to form carbonate linkages uses phosgene as a carbonate precursor, and is referred to as a phosgenation reaction.

Among the phase transfer catalysts that can be used are catalysts of the formula $(R^3)_4Q'X$, wherein each $R^3$ is the same or different, and is a $C_{1-10}$ alkyl group: Q is a nitrogen or phosphorus atom; and X is a halogen atom or a $C_{1-8}$ alkoxy group or $C_{6-18}$ aryloxy group. Exemplary phase transfer catalysts include, for example, $[CH_3(CH_2)_3]_4NX$, $[CH_3(CH_2)_3]_4RX$, $[CH_3(CH_2)_5]_4NX$, $[CH_3(CH_2)_6]_4NX$, $[CH_3(CH_2)_4]_4NX$, $CH_3[CH_3(CH_2)_3]_3NX$, and $CH_3[CH_3(CH_2)_2]_3NX$, wherein X is $Cl^-$, $Br^-$, a $C_{1-8}$ alkoxy group or a $C_{6-18}$ aryloxy group. An effective amount of a phase transfer catalyst can be about 0.1 to about 10 wt % based on the weight of bisphenol in the phosgenation mixture. In another embodiment an effective amount of phase transfer catalyst can be about 0.5 to about 2 wt % based on the weight of bisphenol in the phosgenation mixture.

All types of polycarbonate end groups are contemplated as being useful in the polycarbonate composition, provided that such end groups do not significantly adversely affect desired hydrophobic or adhesion properties of the compositions.

Branched polycarbonate blocks can be prepared by adding a branching agent during polymerization. These branching agents include polyfunctional organic compounds containing at least three functional groups selected from hydroxyl, carboxyl, carboxylic anhydride, haloformyl, and mixtures of the foregoing functional groups. Specific examples include trimellitic acid, trimellitic anhydride, trimellitic trichloride, tris-p-hydroxyphenyl ethane, isatin-bisphenol, trisphenol TC (1,3,5-tris((p-hydroxyphenyl)isopropyl)benzene), trisphenol PA (4(4(1,1-bis(p-hydroxyphenyl)-ethyl)alpha, alpha-dimethyl benzyl)phenol), 4-chloroformyl phthalic anhydride, trimesic acid, and benzophenone tetracarboxylic acid. The branching agents can be added at a level of about 0.05 wt % to about 2.0 wt %. Mixtures comprising linear polycarbonates and branched polycarbonates can be used.

A chain stopper (also referred to as a capping agent) can be included during polymerization. The chain stopper limits molecular weight growth rate, and so controls molecular weight in the polycarbonate. Exemplary chain stoppers include certain mono-phenolic compounds, mono-carboxylic acid chlorides, and/or mono-chloroformates. Mono-phenolic chain stoppers are exemplified by monocyclic phenols such as phenol and $C_1$-$C_{22}$ alkyl-substituted phenols such as p-cumyl-phenol, resorcinol monobenzoate, and p- and tertiary-butyl phenol; and monoethers of diphenols, such as p-methoxy phenol. Alkyl-substituted phenols with branched chain alkyl substituents having 8 to 9 carbon atom are also contemplated. Certain mono-phenolic UV absorbers can also be used as a capping agent, for example 4-substituted-2-hydroxybenzophenones and their derivatives, aryl salicylates, monoesters of diphenols such as resorcinol monobenzoate, 2-(2-hydroxyaryl)-benzotriazoles and their derivatives, 2-(2-hydroxyaryl)-1,3,5-triazines and their derivatives, and the like.

Mono-carboxylic acid chlorides can also be used as chain stoppers. These include monocyclic, mono-carboxylic acid chlorides such as benzoyl chloride, $C_1$-$C_{22}$ alkyl-substituted benzoyl chloride, toluoyl chloride, halogen-substituted benzoyl chloride, bromobenzoyl chloride, cinnamoyl chloride, 4-nadimidobenzoyl chloride, and combinations thereof; polycyclic, mono-carboxylic acid chlorides such as trimellitic anhydride chloride, and naphthoyl chloride; and combinations of monocyclic and polycyclic mono-carboxylic acid chlorides. Chlorides of aliphatic monocarboxylic acids with less than or equal to about 22 carbon atoms are useful. Functionalized chlorides of aliphatic monocarboxylic acids, such as acryloyl chloride and methacryoyl chloride, are also useful. Also useful are mono-chloroformates including monocyclic, mono-chloroformates, such as phenyl chloroformate, alkyl-substituted phenyl chloroformate, p-cumyl phenyl chloroformate, toluene chloroformate, and combinations thereof.

Alternatively, melt processes can be used to make the polycarbonates. Generally, in the melt polymerization process, polycarbonates can be prepared by co-reacting, in a molten state, the dihydroxy reactant(s) and a diaryl carbonate ester, such as diphenyl carbonate, in the presence of a transesterification catalyst in a BANBURY® mixer, twin screw extruder, or the like to form a uniform dispersion. Volatile monohydric phenol is removed from the molten reactants by distillation and the polymer is isolated as a molten residue. A specifically useful melt process for making polycarbonates uses a diaryl carbonate ester having electron-withdrawing substituents on the aryls. Examples of specifically useful diaryl carbonate esters with electron withdrawing substituents include bis(4-nitrophenyl)carbonate, bis(2-chlorophenyl)carbonate, bis(4-chlorophenyl)carbonate, bis(methyl salicyl)carbonate, bis(4-methylcarboxylphenyl)carbonate, bis(2-acetylphenyl)carboxylate, bis(4-acetylphenyl)carboxylate, or a combination comprising at least one of the foregoing esters. In addition, useful transesterification catalysts can include phase transfer catalysts of formula $(R^3)_4Q'X$, wherein each $R^3$, Q, and X are as defined above. Exemplary transesterification catalysts include tetrabutylammonium hydroxide, methyltributylammonium hydroxide, tetrabutylammonium acetate, tetrabutyl phosphonium hydroxide, tetrabutylphosphonium acetate, tetrabutylphosphonium phenolate, or a combination comprising at least one of the foregoing.

The polyester-polycarbonates can also be prepared by interfacial polymerization. Rather than utilizing the dicarboxylic acid or diol per se, the reactive derivatives of the acid or diol, such as the corresponding acid halides, in particular the acid dichlorides and the acid dibromides can be used. Thus, for example instead of using isophthalic acid, terephthalic acid, or a combination comprising at least one of the foregoing acids, isophthaloyl dichloride, terephthaloyl dichloride, or a combination comprising at least one of the foregoing dichlorides can be used.

In addition to the polycarbonates described above, combinations of the polycarbonate with other thermoplastic polymers, for example combinations of homopolycarbonates and/or polycarbonate copolymers with polyesters, can be used. Useful polyesters can include, for example, polyesters having repeating units of formula (7), which include poly(alkylene dicarboxylates), liquid crystalline polyesters, and polyester copolymers. The polyesters described herein are generally completely miscible with the polycarbonates when blended.

The polyesters can be obtained by interfacial polymerization or melt-process condensation as described above, by solution phase condensation, or by transesterification polymerization wherein, for example, a dialkyl ester such as dimethyl terephthalate can be transesterified with ethylene glycol using acid catalysis, to generate polyethylene terephthalate). A branched polyester, in which a branching agent, for example, a glycol having three or more hydroxyl groups or a trifunctional or multifunctional carboxylic acid has been incorporated, can be used. Furthermore, it can be desirable to have various concentrations of acid and hydroxyl end groups on the polyester, depending on the ultimate end use of the composition.

Exemplary polyesters include aromatic polyesters, poly(alkylene esters) including poly(alkylene arylates), and poly(cycloalkylene diesters). Aromatic polyesters can have a polyester structure according to formula (7), wherein J and T are each aromatic groups as described hereinabove. Aromatic polyesters also include, for example, poly(isophthalate-terephthalate-resorcinol) esters, poly(isophthalate-terephthalate, bisphenol A) esters, poly[(isophthalate-terephthalate-resorcinol) ester-co-(isophthalate-terephthalate-bisphenol A)]ester, or a combination comprising at least one of these. Also contemplated are aromatic polyesters with a minor amount, e.g., about 0.5 to about 10 weight percent, based on the total weight of the polyester, of units derived from an aliphatic diacid and/or an aliphatic polyol to make copolyesters. Poly(alkylene arylates) can have a polyester structure according to formula (7), wherein T comprises groups derived from aromatic dicarboxylates, cycloaliphatic dicarboxylic acids, or derivatives thereof. Examples of T groups include 1,2-, 1,3-, and 1,4-phenylene; 1,4- and 1,5-naphthylenes; cis- or trans-1,4-cyclohexylene; and the like. Where T is 1,4-phenylene, the poly(alkylene arylate) can be a poly(alkylene terephthalate). In addition, for poly(alkylene arylate), alkylene groups J include, for example, ethylene, 1,4-butylene, and bis-(alkylene-disubstituted cyclohexane) including cis- and/or trans-1,4-(cyclohexylene)dimethylene. Examples of poly(alkylene terephthalates) include poly(ethylene terephthalate) (PET), poly(1,4-butylene terephthalate) (PBT), and poly(propylene terephthalate) (PPT). Exemplary poly(alkylene naphthoates) include poly(ethylene naphthanoate) (PEN), and poly(butylene naphthanoate) (PBN). Also contemplated are poly(cycloalkylene diester) is poly(cyclohexanedimethylene terephthalate) (PCT). Combinations comprising at least one of the foregoing polyesters are also contemplated.

Copolymers comprising alkylene terephthalate repeating ester units with other ester groups are contemplated. Specifically useful ester units can include different alkylene terephthalate units, which can be present in the polymer chain as individual units, or as blocks of poly(alkylene terephthalates). Exemplary copolymers of this type include poly(cyclohexanedimethylene terephthalate)-co-poly(ethylene terephthalate), abbreviated as PETG where the polymer comprises greater than or equal to 50 mole % of poly(ethylene terephthalate), and abbreviated as PCTG where the polymer comprises greater than 50 mole % of poly(1,4-cyclohexanedimethylene terephthalate).

Poly(cycloalkylene diester)s include poly(alkylene cyclohexanedicarboxylate)s which include poly(1,4-cyclohexanedimethanol-1,4-cyclohexanedicarboxylate) (PCCD), having recurring units of formula (9):

(9)

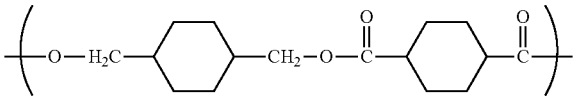

wherein, as described using formula (7), J is a 1,4-cyclohexanedimethylene group derived from 1,4-cyclohexanedimethanol, and T is a cyclohexane ring derived from cyclohexanedicarboxylate or a chemical equivalent thereof, and can comprise the cis-isomer, the trans-isomer, or a combination comprising at least one of the foregoing isomers.

The polycarbonate and polyester can be used in a weight ratio of 1:99 to 99:1, specifically 10:90 to 90:10, and more specifically 30:70 to 70:30, depending on the function and properties desired.

It is desirable for such a polyester and polycarbonate blend to have an MVR of about 5 ml/10 minutes to about 150 ml/10 minutes, specifically about 7 ml/10 minutes to about 125 ml/10 minutes, more specifically about 9 ml/10 minutes to about 110 ml/10 minutes, and still more specifically about 10 ml/10 minutes to about 100 ml/10 minutes, measured at 300° C. and a load of 1.2 kilograms according to ASTM D1238-04

The hydrophobic layer can further comprise a polysiloxane-polycarbonate copolymer, also referred to as a polysiloxane-polycarbonate. The polydiorganosiloxane (also referred to herein as "polysiloxane") blocks of the copolymer comprise repeating diorganosiloxane units of formula (10):

(10)

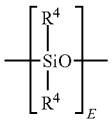

wherein each occurrence of $R^4$ is independently the same or different $C_{1-13}$ monovalent organic group. For example, $R^4$ can be a $C_1$-$C_{13}$ alkyl, $C_1$-$C_{13}$ alkoxy, $C_2$-$C_{13}$ alkenyl group, $C_2$-$C_{13}$ alkenyloxy, $C_3$-$C_6$ cycloalkyl, $C_3$-$C_6$ cycloalkoxy, $C_6$-$C_{14}$ aryl, $C_6$-$C_{10}$ aryloxy, arylalkyl, $C_7$-$C_{13}$ aralkoxy, $C_7$-$C_{13}$ alkylaryl, or $C_7$-$C_{13}$ alkylaryloxy. The foregoing groups can be fully or partially halogenated with fluorine, chlorine, bromine, or iodine, or a combination thereof. In an embodiment, where a transparent polysiloxane-polycarbonate is desired. $R^4$ is unsubstituted by halogen. Combinations of the foregoing $R^4$ groups can be used in the same copolymer.

The value of E in formula (10) can vary widely depending on the type and relative amount of each component in the thermoplastic composition, the desired properties of the composition, and like considerations. Generally, E has an average value of about 2 to about 1,000, specifically about 2 to about 500, more specifically about 5 to about 100. In one embodiment, E has an average value of about 10 to about 75, and in still another embodiment, E has an average value of about 40 to about 60. Where E is of a lower value, e.g., less than about 40, it can be desirable to use a relatively larger amount of the polycarbonate-polysiloxane copolymer. Conversely, where E is of a higher value, e.g., greater than about 40, a relatively lower amount of the polycarbonate-polysiloxane copolymer can be used.

A combination of a first and a second (or more) polycarbonate-polysiloxane copolymer can be used, wherein the average value of E of the first copolymer is less than the average value of E of the second copolymer.

In one embodiment, the polydiorganosiloxane blocks are provided by repeating structural units of formula (11):

(11)

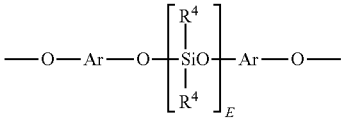

wherein E is as defined above; each $R^4$ can be the same or different, and is as defined above; and Ar can be the same or different, and is a substituted or unsubstituted $C_6$-$C_{30}$ arylene group, wherein the bonds are directly connected to an aromatic moiety. Ar groups in formula (11) can be derived from a $C_6$-$C_{30}$ dihydroxyarylene compound, for example a dihydroxyarylene compound of formula (3) or (6) above. Exemplary dihydroxyarylene compounds are 1,1-bis(4-hydroxyphenyl)methane, 1,1-bis(4-hydroxyphenyl)ethane, 2,2-bis(4-hydroxyphenyl)propane, 2,2-bis(4-hydroxyphenyl)butane, 2,2-bis(4-hydroxyphenyl)octane, 1,1-bis(4-hydroxyphenyl)propane, 1,1-bis(4-hydroxyphenyl)n-butane, 2,2-bis(4-hydroxy-1-methylphenyl)propane, 1,1-bis(4-hydroxyphenyl)cyclohexane, bis(4-hydroxyphenyl sulfide), and 1,1-bis(4-hydroxy-t-butylphenyl)propane. Combinations comprising at least one of the foregoing dihydroxy compounds can also be used.

In another embodiment, polydiorganosiloxane blocks comprises units of formula (13):

(13)

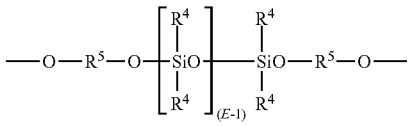

wherein $R^4$ and E are as described above, and each occurrence of $R^5$ is independently a divalent $C_1$-$C_{30}$ organic group, and wherein the polymerized polysiloxane unit is the reaction residue of its corresponding dihydroxy compound. In a specific embodiment, the polydiorganosiloxane blocks are provided by repeating structural units of formula (14):

(14)

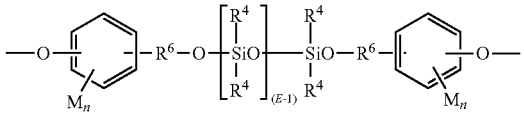

wherein $R^4$ and E are as defined above. $R^6$ in formula (14) is a divalent $C_2$-$C_8$ aliphatic group. Each M in formula (14) can be the same or different, and can be a halogen, cyano, nitro, $C_1$-$C_8$ alkylthio, $C_1$-$C_8$ alkyl, $C_1$-$C_8$ alkoxy, $C_2$-$C_8$ alkenyl, $C_2$-$C_8$ alkenyloxy group, $C_3$-$C_8$ cycloalkyl, $C_3$-$C_8$ cycloalkoxy, $C_6$-$C_{10}$ aryl, $C_6$-$C_{10}$ aryloxy, $C_7$-$C_{12}$ aralkyl, $C_7$-$C_{12}$ aralkoxy, $C_7$-$C_{12}$ alkylaryl, or $C_7$-$C_{12}$ alkylaryloxy, wherein each n is independently 0, 1, 2, 3, or 4.

In one embodiment, M is bromo or chloro, an alkyl group such as methyl, ethyl, or propyl, an alkoxy group such as methoxy, ethoxy, or propoxy, or an aryl group such as phenyl, chlorophenyl, or tolyl; $R^6$ is a dimethylene, trimethylene or tetramethylene group; and $R^4$ is a $C_{1-8}$ alkyl, haloalkyl such as trifluoropropyl, cyanoalkyl, or aryl such as phenyl, chlorophenyl or tolyl. In another embodiment, $R^4$ is methyl, or a combination of methyl and trifluoropropyl, or a combination of methyl and phenyl. In still another embodiment, M is methoxy, n is one, $R^6$ is a divalent $C_1$-$C_3$ aliphatic group, and $R^4$ is methyl.

Units of formula (14) can be derived from the corresponding dihydroxy polydiorganosiloxane (15):

(15)

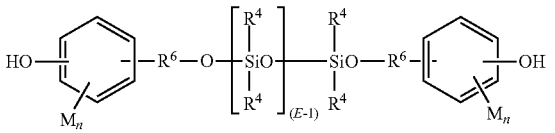

wherein $R^4$, E, M, $R^6$, and n are as described above. Such dihydroxy polysiloxanes can be made by effecting a platinum-catalyzed addition between a siloxane hydride of formula (16):

(16)

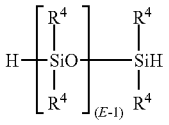

wherein $R^4$ and E are as previously defined, and an aliphatically unsaturated monohydric phenol. Exemplary aliphatically unsaturated monohydric phenols include eugenol, 2-alkylphenol, 4-allyl-2-methylphenol, 4-allyl-2-phenylphenol, 4-allyl-2-bromophenol, 4-allyl-2-t-butoxyphenol, 4-phenyl-2-phenylphenol, 2-methyl-4-propylphenol, 2-allyl-4,6-dimethylphenol, 2-allyl-4-bromo-6-methylphenol, 2-allyl-6-methoxy-4-methylphenol and 2-allyl-4,6-dimethylphenol. Combinations comprising at least one of the foregoing can also be used.

The polyorganosiloxane-polycarbonate can comprise about 50 wt % to about 99 wt % of carbonate units and about 1 wt % to about 50 wt % siloxane units. Within this range, the polyorganosiloxane-polycarbonate copolymer can comprise about 70 wt % to about 98 wt %, more specifically about 75 wt % to about 97 wt % of carbonate units and about 2 wt % to about 30 wt %, more specifically about 3 wt % to about 25 wt % siloxane units.

Polyorganosiloxane-polycarbonates can have a weight average molecular weight of about 2,000 to about 100,000 Daltons, specifically about 5,000 to about 50,000 Daltons as measured by gel permeation chromatography using a crosslinked styrene-divinyl benzene column, at a sample concentration of 1 milligram per milliliter, and as calibrated with polycarbonate standards.

The polyorganosiloxane-polycarbonate can have a melt volume flow rate, measured at 300° C./1.2 kg, of about 1 ml/10 minutes to about 50 ml/10 minutes, specifically about 2 ml/10 minutes to about 30 ml/10 minutes. Mixtures of polyorganosiloxane-polycarbonates of different flow properties can be used to achieve the overall desired flow property.

The hydrophobic or super-hydrophobic layer can further comprise a styrene polymer or copolymer of one or at least two ethylenically unsaturated monomers (vinyl monomers), such as, for example, those of styrene, α-methylstyrene, ring-substituted styrenes, acrylonitrile, methacrylonitrile, methyl methacrylate, maleic anhydride, N-substituted maleimides and (meth)acrylates having 1 to 18 carbon atoms in the alcohol component.

More particularly, styrene copolymers include those comprising at least one monomer from the series styrene, α-methylstyrene and/or ring-substituted styrene with at least one monomer from the series acrylonitrile, methacrylonitrile, methyl methacrylate, maleic anhydride and/or N-substituted maleimide. In one embodiment, the styrene copolymer comprises about 60 wt % to about 95 wt % styrene monomers and about 40 wt % to about 5 wt % of other vinyl monomers based on the total weight of the styrene copolymer.

Other exemplary copolymers of styrene include those with acrylonitrile and optionally with methyl methacrylate, of α-methylstyrene with acrylonitrile and optionally with methyl methacrylate, or of styrene and α-methylstyrene with acrylonitrile and optionally with methyl methacrylate. Styrene-acrylonitrile copolymers can be prepared by free-radical polymerization, in particular by emulsion, suspension, solution or bulk polymerization. The copolymers preferably have molecular weights $M_w$ (weight-average, determined by light scattering or sedimentation) between about 15,000 g/mole and about 200,000 g/mole.

In one embodiment the styrene copolymer is derived from styrene and maleic anhydride, and prepared from the corresponding monomers by continuous bulk or solution polymerization. The proportions of the two components of the random styrene-maleic anhydride copolymers can be varied within wide limits. In particular, the styrene copolymer comprises about 5 wt % to 25 wt % maleic anhydride based on total weight of the styrene copolymer.

In another embodiment the styrene copolymer comprises ring-substituted styrenes, such as p-methylstyrene, 2,4-dimethylstyrene and other substituted styrenes, such as α-methylstyrene. The molecular weights (number-average $M_n$) of the styrene-maleic anhydride copolymers can vary over a wide range, more particularly from about 60,000 g/mol to about 200,000 g/mol.

Thermoplastic polymers also include grail copolymers. Graft copolymers can be prepared by first polymerizing a conjugated diene monomer (such as butadiene) with a monomer copolymerizable therewith (such as styrene) to provide an elastomeric polymeric backbone. After formation of the polymeric backbone, at least one grafting monomer, and preferably two, are polymerized in the presence of the polymer backbone to obtain the graft copolymer.

Exemplary conjugated diene monomers for preparing the polymeric backbone of the graft copolymer are of formula (17):

(17)

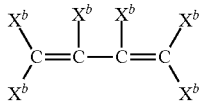

wherein $X^b$ is hydrogen, $C_1$-$C_5$ alkyl, chlorine, bromine, or the like. Examples of conjugated diene monomers that can be used are butadiene, isoprene, 1,3-heptadiene, methyl-1,3-pentadiene, 2,3-dimethyl-1,3-butadiene, 2-ethyl-1,3-pentadiene; 1,3- and 2,4-hexadienes, chloro and bromo substituted butadienes such as dichlorobutadiene, bromobutadiene, dibromobutadiene, mixtures comprising at least one of the foregoing conjugated diene monomers, and the like.

Monomers copolymerizable with the conjugated diene monomer, and grafting monomers, include vinylaromatic monomers and/or (meth)acrylic monomers. Exemplary vinylaromatic monomers include vinyl-substituted condensed aromatic ring structures, such as vinyl naphthalene, vinyl anthracene and the like, or monomers of formula (18):

(18)

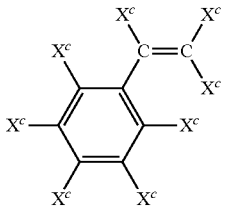

wherein each $X^c$ is independently hydrogen. $C_1$-$C_{12}$ alkyl (including cycloalkyl), $C_6$-$C_{12}$ aryl, $C_7$-$C_{12}$ aralkyl, $C_7$-$C_{12}$ alkaryl, $C_1$-$C_{12}$ alkoxy, $C_6$-$C_{12}$ aryloxy, chlorine, bromine, or hydroxy. Examples of the monovinyl aromatic monomers include styrene, 3-methylstyrene, 3,5-diethylstyrene, 4-n-propylstyrene, alpha-methylstyrene, alpha-methyl vinyltoluene, alpha-chlorostyrene, alpha-bromostyrene, dichlorostyrene, dibromostyrene, tetra-chlorostyrene, combinations comprising at least one of the foregoing compounds, and the like. Styrene and/or alpha-methylstyrene are commonly used as monomers copolymerizable with the conjugated diene monomer and/or as grafting monomers.

Exemplary (meth)acrylic monomers are of formula (19):

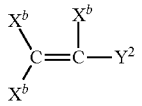

(19)

wherein $X^b$ is as previously defined and $Y^2$ is cyano, $C_1$-$C_{12}$ alkoxycarbonyl, or the like. Examples of such monomers include acrylonitrile, ethacrylonitrile, methacrylonitrile, alpha-chloroacrylonitrile, beta-chloroacrylonitrile, alpha-bromoacrylonitrile, beta-bromoacrylonitrile, methyl acrylate, methyl methacrylate, ethyl acrylate, n-butyl acrylate, n-butyl methacrylate, propyl acrylate, isopropyl acrylate, 2-ethylhexyl acrylate, combinations comprising at least one of the foregoing monomers, and the like. Monomers such as n-butyl acrylate, ethyl acrylate, and 2-ethylhexyl acrylate are commonly used as monomers copolymerizable with the conjugated diene monomer. Acrylonitrile, ethyl acrylate, and methyl methacrylate are commonly used as grafting monomers.

In the preparation the graft copolymer, the polymeric backbone can comprise about 5 wt % to about 60 wt % of the total graft copolymer composition. The monomers polymerized in the presence of the polymeric backbone, exemplified by styrene and acrylonitrile, can comprise from about 40 wt % to about 95% of the total graft polymer. In preparing the graft copolymer, it is normal to have a certain percentage of the polymerizing monomers that are grafted on the polymeric backbone combine with each other as free copolymer. If styrene is utilized as one of the grafting monomers and acrylonitrile as the second grafting monomer, a certain portion of the composition will copolymerize as free styrene-acrylonitrile copolymer. Also, there are occasions where a copolymer such as styrene-acrylonitrile is added to the graft polymer copolymer blend. Thus, the graft copolymer can, optionally, comprise up to about 80 wt % of free copolymer, based on the total weight of the graft copolymer.

Bulk or emulsion polymerization processes can be used to produce the graft copolymers. In one embodiment, the impact modifier comprises a high rubber graft ABS copolymer produced in a process that includes an emulsion polymerization step. "High rubber graft" as used herein refers to graft copolymer resins wherein at least about 30 wt %, preferably at least about 45 wt %, of the rigid polymeric phase is chemically bound or grafted to the elastomeric polymeric backbone. ABS high rubber graft copolymers are commercially available from, for example, GE Plastics, Inc. under the trademark BLENDEX and include grades 131, 336, 338, 360, and 415.

Exemplary core-shell impact modifiers include (meth) acrylate rubbers having a cross-linked or partially crosslinked (meth)acrylate elastomeric (rubbery) core phase and an outer resin shell that interpenetrates the elastomeric core phase. The interpenetrating network is provided when the monomers forming the resin phase are polymerized and cross-linked in the presence of the previously polymerized and cross-linked (meth)acrylate rubbery core phase.

Various (meth)acrylates can be used to form the elastomeric core phase. As used herein, "(meth)acrylate" is inclusive of both acrylates and methacrylates. n-Butyl acrylate, ethyl acrylate, 2-ethylhexyl acrylate, mixtures comprising at least one of the foregoing, and the like can be used to form the rubbery core phase. Small amounts of other (meth)acrylic monomers such as acrylonitrile or methacrylonitrile can be incorporated in the rubbery core phase.

Vinylaromatic monomers and/or (meth)acrylic monomers as described above can be used to form the outer resin shell phase, in particular styrene, alpha-methyl styrene, p-methyl styrene, vinyl toluene, vinyl xylene, acrylonitrile, methacrylonitrile, and mixtures comprising at least one of the foregoing monomers.

The graft polymers are partially crosslinked and have gel contents of more than 20 wt %, more particularly more than 40 wt %, and most particularly more than 60 wt % based on the total weight of the graft polymer. In one embodiment the graft copolymer is an ABS polymer. The graft copolymers can be prepared by known processes such as bulk, suspension, emulsion or bulk-suspension processes.

Thermoplastic polyamides which can be used are polyamide 66 (polyhexamethylene adipamide) or polyamides of cyclic lactams having 6 to 12 carbon atoms, for example laurolactam and ∈-caprolactam, polyamide 6 (polycaprolactam) or copolyamides with main constituents polyamide 6 or polyamide 66 or mixtures whose main constituents are these polyamides. These materials can be prepared by activated anionic polymerization.

The hydrophobic or super-hydrophobic layer can further comprise one or more fillers, including the aforementioned ceramic materials for the hydrophilic layer, providing the properties of the hydrophobic layer are not adversely affected. Fillers include particulate fillers and fibrous fillers. Examples of such fillers are well known in the art and include those described in "Plastic Additives Handbook, 4th Edition" R. Gachter and H. Muller (eds.), P. P. Klemchuck (assoc. ed.) Hanser Publishers, New York 1993, pages 901-948. A particulate filler is herein defined as a filler having an average aspect ratio less than about 5:1. Non-limiting examples of fillers include silica powder, such as fused silica and crystalline silica; boron-nitride powder and boron-silicate powders for obtaining cured products having high thermal conductivity, low dielectric constant and low dielectric loss tangent; the above-mentioned powder as well as alumina, and magnesium oxide (or magnesia) for high temperature conductivity: and fillers, such as wollastonite including surface-treated wollastonite, calcium sulfate (in its anhydrous, hemihydrated, dihydrated, or trihydrated forms), calcium carbonate including chalk, limestone, marble and synthetic, precipitated calcium carbonates, generally in the form of a ground particulate which often comprises at least 98 wt % $CaCO_3$ with the remainder being other inorganics such as magnesium carbonate, iron oxide, and alumino-silicates surface-treated calcium carbonates; talc, including fibrous, nodular, needle shaped, and lamellar talc; glass spheres, both hollow and solid, and surface-treated glass spheres typically having coupling agents such as silane coupling agents and/or containing a conductive coating; and kaolin, including hard, soft, calcined kaolin, and kaolin comprising various coatings known to the art to facilitate the dispersion in and compatibility with the thermoset resin; mica, including metallized mica and mica surface treated with aminosilane or acryloylsilane coatings to impart good physical properties to compounded blends; feldspar and nepheline syenite; silicate spheres; flue dust; cenospheres; fillite; aluminosilicate (armospheres), including silanized and metallized aluminosilicate; natural silica sand;

quartz; quartzite: perlite; Tripoli; diatomaceous earth; synthetic silica, including those with various silane coatings, and the like.

In one embodiment, the particulate filler is a fused silica having an average particle size of about 1 micrometer to about 50 micrometers. A representative particulate filler comprises a first fused silica having a median particle size of about 0.03 micrometer to less than 1 micrometer, and a second fused silica having a median particle size of at least 1 micrometer to about 30 micrometers. The fused silicas can have essentially spherical particles, typically achieved by re-melting. Within the size range specified above, the first fused silica can specifically have a median particle size of at least about 0.1 micrometer, specifically at least about 0.2 micrometer. Also within the size range above, the first fused silica can specifically have a median particle size of up to about 0.9 micrometer, more specifically up to about 0.8 micrometer. Within the size range specified above, the second fused silica can specifically have a median particle size of at least about 2 micrometers, specifically at least about 4 micrometers. Also within the size range above, the second fused silica can specifically have a median particle size of up to about 25 micrometers, more specifically up to about 20 micrometers. In one embodiment, the composition comprises the first fused silica and the second fused silica in a weight ratio in a range of about 70:30 to about 99:1, specifically in a range of about 80:20 to about 95:5.

Fibrous fillers include short inorganic fibers, including processed mineral fibers such as those derived from blends comprising at least one of aluminum silicates, aluminum oxides, magnesium oxides, and calcium sulfate hemi-hydrate. Also included among fibrous fillers are single crystal fibers or "whiskers" including silicon carbide, alumina, boron carbide, carbon, iron, nickel, or copper. Also included among fibrous fillers are glass fibers, including textile glass fibers such as E, A, C, ECR, R, S, D, and NE glasses and quartz. Representative fibrous fillers include glass fibers having a diameter in a range of about 5 micrometers to about 25 micrometers and a length before compounding in a range of about 0.5 centimeters to about 4 centimeters. Many other fillers are described in U.S. Pat. No. 6,627,704 B2 to Yeager et al.

The hydrophobic layer can further contain adhesion promoters to improve adhesion of the thermosetting resin to the filler or to an external coating or substrate. Also contemplated is treatment of the aforementioned inorganic fillers with adhesion promoter to improve adhesion. Adhesion promoters include chromium complexes, silanes, titanates, zirco-aluminates, propylene maleic anhydride copolymers, reactive cellulose esters and the like. Chromium complexes include those sold by DuPont under the trade name VOLAN®. Silanes include molecules having the general structure $(R^7O)_{(4-n)}SiY_n$ wherein n=1-3, $R^7$ is an alkyl or aryl group and Y is a reactive functional group which can enable formation of a bond with a polymer molecule. Particularly useful examples of coupling agents are those having the structure $(R^7O)_3SiY$. Typical examples include vinyl triethoxysilane, vinyl tris(2-methoxy)silane, phenyl trimethoxysilane, γ-methacryloxypropyltrimethoxy silane, γ-aminopropyltriethoxysilane, γ-glycidoxypropyltrimethoxysilane, γ-mercaptopropyltrimethoxysilane, and the like. Silanes further include molecules lacking a reactive functional group, such as, for example, trimethoxyphenylsilane. Titanates include those developed by S. J. Monte et al. in Ann. Chem. Tech Conf. SPI (1980), Ann. Tech Conf. Reinforced Plastics and Composite Inst. SPI 1979. Section 16E, New Orleans: and S. J. Monte. Mod. Plastics Int., volume 14, number 6, pg. 2 (1984). Zirco-aluminates include those described by L. B. Cohen in Plastics Engineering, volume 39, number 11, page 29 (1983). The adhesion promoter can be included in the thermosetting or thermoplastic resin itself, or coated onto any of the fillers described above to improve adhesion between the filler and the thermosetting or thermoplastic resin. For example such promoters can be used to coat a silicate fiber or filler to improve adhesion of the resin matrix.

When present, the particulate filler can be used in an amount of about 5 wt % to about 95 wt %, based on the total weight of the composition. Within this range, the particulate filler amount can specifically be at least about 20 wt %, more specifically at least about 40 wt %, even more specifically at least about 75 wt %. Also within this range, the particulate filler amount can specifically be up to about 93 wt %, more specifically up to about 91 wt %.

When present, the fibrous filler can be used in an amount of about 2 wt % to about 80 wt %, based on the total weight of the composition. Within this range, the fibrous filler amount can specifically be at least about 5 wt %, more specifically at least about 10 wt %), yet more specifically at least about 15 wt %. Also within this range the fibrous filler amount can specifically be up to about 60 wt %, more specifically up to about 40 wt %, still more specifically up to about 30 wt %.

The aforementioned fillers can be added to the thermosetting or thermoplastic resin without any treatment, or after surface treatment, generally with an adhesion promoter.

Also disclosed is a method of forming a hydrophobic or super-hydrophobic layer, comprising preparing a coating mixture comprising thermoplastic or thermosetting resin and a filler; coating a selected surface of a centrifugal compressor to form the hydrophobic layer on the selected surface; and curing the hydrophobic layer. In one embodiment, the coating mixture comprises a hydrophobic siloxane material. In one embodiment the filler is surface treated with a siloxane material. In an embodiment, the coating mixture further comprises a solvent, and the solvent is removed prior to curing. Curing can be accomplished by means of heating or by light exposure using methods known in the art. It will be understood that the term "curing" includes partially curing and fully curing. Because the components of the curable composition may react with each other during curing, the cured compositions may be described as comprising the reaction products of the curable composition components.

The coating mixture can be applied to a selected substrate surface by any known method including spray coating, dip coating, powder coating, and the like.

The thickness of the hydrophilic, super-hydrophilic, hydrophobic, and/or super-hydrophobic layers is typically in the range of from about 25 to about 2500 micrometers and will depend upon a variety of factors, including the design parameters for the selected surface involved. In one embodiment, the hydrophilic, super-hydrophilic, hydrophobic, and/or super-hydrophobic layers have, independently, a thickness of about 700 micrometers to about 1800 micrometers, more particularly from about 1000 micrometers to about 1500 micrometers. In another embodiment the hydrophilic, super-hydrophilic, hydrophobic, and/or super-hydrophobic layers have, independently, a thickness in the range of about 25 micrometers to about 700 micrometers, and more particularly about 80 micrometers to about 500 micrometers. In one embodiment, the optional bond coat layer has a thickness of about 25 micrometers to about 500 micrometers, more particularly from about 75 micrometers to about 300 micrometers. In another embodiment the bond coat layer has a thickness in the range of about 25 micrometers to about 75 micrometers.

In another embodiment a method comprises disposing a hydrophobic or super-hydrophobic surface layer on at least one of an inlet guide vane, impeller, return channel straight hub, or exiting hub bend of at least one stage of a centrifugal compressor; and/or disposing a hydrophilic and/or super-hydrophilic surface layer on at least one of the impeller casing, diffuser casing, exiting casing bend, return channel straight hub, exiting hub bend, collection point, or drain of the at least one stage; wherein the centrifugal compressor is suited to separate a liquid phase and a gas phase from a wet gas mixture.

The singular forms "a," "an," and "the" include plural referents unless the context clearly dictates otherwise. The endpoints of all ranges directed to the same characteristic or component are independently combinable and inclusive of the recited endpoint.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A centrifugal compressor comprising at least one stage suited to separate a liquid phase and a gas phase, said compressor comprising at least one of an inlet guide vane, impeller, return channel straight hub, or exiting hub bend, and further comprising at least one of an impeller casing, diffuser casing, exiting casing bend, collection point, or drain, wherein:

the compressor comprises a hydrophobic and/or super-hydrophobic surface layer disposed on at least one of the inlet guide vane, impeller, return channel straight hub, or exiting hub bend: and the compressor further comprises a hydrophilic and/or super-hydrophilic surface disposed on at least one of the impeller casing, diffuser casing, exiting casing bend, return channel straight hub, exiting hub bend, collection point, or drain.

2. The centrifugal compressor of claim 1, wherein the compressor has 1 to 10 stages.

3. The centrifugal compressor of claim 1, wherein the wet gas mixture has a moisture content from greater than 0% up to 5% by volume.

4. The centrifugal compressor of claim 1, comprising at least one stage configured to compress a dry gas.

5. The centrifugal compressor of claim 1, wherein the hydrophilic layer comprises a metal, ceramic or metal/ceramic material and is bonded to the first surface by a brazing alloy.

6. The centrifugal compressor of claim 1, wherein the hydrophilic layer comprises a metal oxide material selected from the group comprised of unhydrated alumina, hydrated alumina, erbia, yttria, calcia, ceria, scandia, magnesia, india, ytterbia, lanthana, gadolinia, neodymia, sarnaria, dysprosia, zirconia, europia, neodymia, praseodymia, urania, hafnia, yttria-stabilized zirconias, ceria-stabilized zirconias, calcia-stabilized zirconias, scandia-stabilized zirconias, magnesia-stabilized zirconias, india-stabilized zirconias, ytterbia-stabilized zirconias, and combinations comprising at least one of the foregoing materials.

7. The centrifugal compressor of claim 1, wherein the hydrophilic layer comprises gadolinium-zirconate, lanthanum titanate, lanthanum zirconate, yttrium zirconate, lanthanum hafnate, cerium zirconate, aluminum cerate, cerium hafnate, aluminum hafnate, or lanthanum cerate.

8. The centrifugal compressor of claim 1, wherein the hydrophobic, super-hydrophobic, hydrophilic and/or super-hydrophilic surface layer further comprises a bond coat layer intermediate to the respective hydrophobic, super-hydrophobic, hydrophilic and/or super-hydrophilic surface layer.

9. The centrifugal compressor of claim 1, wherein the hydrophobic layer comprises a metal selected from the group comprised of beryllium, magnesium, scandium, titanium, vanadium, chromium, manganese, iron, cobalt, nickel, copper, zinc, gallium, yttrium, zirconium, niobium, molybdenum, technetium, ruthenium, rhenium, palladium, silver, cadmium, indium, tin, lanthanum, cerium, praseodymium, neodymium, samarium, europium, gadolinium, terbium, dysprosium, holmium, erbium, thulium, ytterbium, lutetium, hafnium, tantalum, tungsten, rhenium, osmium, iridium, platinum, gold, thallium, lead, bismuth, and combinations comprising at least one of the foregoing metals.

10. The centrifugal compressor of claim 9, wherein the metal is titanium, aluminum, magnesium, nickel, an aluminum-magnesium alloy, or a combination thereof.

11. The centrifugal compressor of claim 1, wherein the hydrophobic layer comprises a thermosetting or thermoplastic polymer.

12. The centrifugal compressor of claim 11, wherein the thermosetting polymer comprises a resin selected from the group comprised of diallyl phthalate resin, epoxy resin, urea-formaldehyde resin, melamine-formaldehyde resin, melamine-phenol-formaldehyde resin, phenol-formaldehyde resin, polyimide, silicone rubber, unsaturated polyester resins, and a combination comprising at least one of the foregoing thermosetting polymers.

13. The centrifugal compressor of claim 11, wherein the thermoplastic resin is a material selected from the group comprised of polypropylene, polyethylene, polysiloxane, polycarbonate, polyorganosiloxane-polycarbonate, polyester, polyester carbonate, polystyrene, styrene copolymer, styrene-acrylonitrile (SAN) resin, rubber-containing styrene graft copolymer, polyamide, polyurethane, polyphenylene sulphide, polyvinyl chloride, and a combination comprising at least one of the foregoing thermoplastic resins.

14. A method, comprising:

disposing a hydrophobic and/or super-hydrophobic surface layer on at least one of an inlet guide vane, impeller, return channel straight hub, or exiting hub bend of at least one stage of a centrifugal compressor; and disposing a hydrophilic and/or super-hydrophilic surface layer on at least one of the impeller casing, diffuser casing, exiting casing bend, return channel straight hub, exiting hub bend, collection point, or drain of the at least one stage; wherein the centrifugal compressor is suited to separate a liquid phase and a gas phase from a wet gas mixture.

15. The method of claim 14, wherein disposing the hydrophilic layer comprises heating the hydrophilic layer to a temperature effective in volatilizing a vaporizable organic binder.

16. The method of claim 14, wherein the hydrophilic, super-hydrophilic, hydrophobic and super-hydrophobic surface layers are disposed on a bond coat layer.

17. The method of claim 14, wherein the wet gas mixture has a moisture content from greater than 0% up to 5% by volume.

* * * * *